US012601139B2

(12) United States Patent
Yonekura et al.

(10) Patent No.: US 12,601,139 B2
(45) Date of Patent: Apr. 14, 2026

(54) CONSTRUCTION MACHINE ATTACHMENT MOUNTING AND DEMOUNTING APPARATUS AND CONSTRUCTION MACHINE EQUIPPED WITH SAME

(71) Applicant: YANMAR HOLDINGS CO., LTD., Osaka (JP)

(72) Inventors: Kiyoshi Yonekura, Fukuoka (JP); Masami Miyanishi, Fukuoka (JP); Yuta Makino, Fukuoka (JP)

(73) Assignee: YANMAR HOLDINGS CO., LTD., Osaka (JP)

( * ) Notice: Subject to any disclaimer, the term of this patent is extended or adjusted under 35 U.S.C. 154(b) by 439 days.

(21) Appl. No.: 18/304,054

(22) Filed: Apr. 20, 2023

(65) Prior Publication Data

US 2023/0366170 A1 Nov. 16, 2023

(30) Foreign Application Priority Data

May 13, 2022 (JP) ..... 2022-079400

(51) Int. Cl.
*E02F 3/36* (2006.01)

(52) U.S. Cl.
CPC ..... *E02F 3/3663* (2013.01)

(58) Field of Classification Search
CPC ..... E02F 3/3663; E02F 3/3618; E02F 3/3645; E02F 3/3604; E02F 3/3622; E02F 3/365; E02F 9/2296; E02F 9/226; E02F 9/2275; F16L 37/36; F16L 37/56
See application file for complete search history.

(56) References Cited

U.S. PATENT DOCUMENTS 8,684,623 B2 * 4/2014 Robl ..... E02F 3/364 37/468
10,975,544 B1 * 4/2021 Clemons ..... E02F 3/3622
2017/0107687 A1 4/2017 Ito et al.

FOREIGN PATENT DOCUMENTS

JP 6284445 B2 2/2018

* cited by examiner

*Primary Examiner* — Joseph M Rocca
*Assistant Examiner* — Robert E Pezzuto
(74) *Attorney, Agent, or Firm* — Future IP LLC; Tomoko Nakajima

(57) ABSTRACT

An attachment mounting and demounting apparatus includes: a fixed frame that has a first hook; a movable frame that has a second hook and is rotatably provided to the fixed frame; a first hydraulic cylinder that rotates the movable frame relative to the fixed frame; a back locking member provided to the fixed frame; a second hydraulic cylinder provided to the fixed frame to rotate the back locking member biased to a locked position by a lock spring, to an unlocked position; a front locking member provided to the movable frame and biased to a locked position by a lock spring; and a third hydraulic cylinder provided to the movable frame to rotate the front locking member to an unlocked position.

9 Claims, 12 Drawing Sheets

CONSTRUCTION MACHINE ATTACHMENT MOUNTING AND DEMOUNTING APPARATUS AND CONSTRUCTION MACHINE EQUIPPED WITH SAME

This application claims priority under 35 U.S.C. § 119 to Japanese Patent Application No. 2022-079400, filed May 13, 2022, which is incorporated by reference.

TECHNICAL FIELD

The present disclosure relates to a construction machine attachment mounting and demounting apparatus that couples a construction machine attachment for work to an arm of a working device, and a construction machine equipped with the same.

BACKGROUND ART

Conventionally, examples of an excavation work machine that is a type of construction machine include one that is configured in such a manner as to detachably provide an attachment for work to an arm constituting an excavation device as a front working device. As the attachment, a bucket for excavation work, a crushing device (breaker) for crushing work, or the like is replaced according to the work content. The attachment is coupled to the arm via an attachment mounting and demounting apparatus provided at the distal end of the arm, and is mounted on and demounted from the arm by operating the attachment mounting and demounting apparatus.

As the attachment mounting and demounting apparatus, there is an attachment mounting and demounting apparatus that includes a fixed hook and a movable hook that are provided to predetermined frames, and is configured in such a manner that each hook is engaged with a support pin included in an attachment as an engaged portion to be coupled to the attachment. One with such a configuration is known which includes a hydraulic cylinder for moving the movable hook to perform the attachment mounting and demounting actions on the basis of the extension and contraction of the hydraulic cylinder (refer to, for example, Patent Document 1.).

Moreover, the attachment mounting and demounting apparatus of Patent Document 1 is provided with locking members for preventing the support pins of the attachment from coming out of the hooks, and is configured in such a manner that the operation and cancelation of the retaining function of the locking members is automatically performed when the attachment is mounted and demounted.

PRIOR ART DOCUMENT

Patent Document

Patent Document 1: Japanese Patent No. 6284445

SUMMARY OF INVENTION

Technical Problem

In the attachment mounting and demounting apparatus of Patent Document 1, the locking member provided to each of the fixed hook and the movable hook is movable between a lock-on position where the support pin of the attachment is retained and a lock-off position where the retention is cancelled, and the locking member of the movable hook is biased toward the lock-on position by a biasing member. The locking member of the fixed hook and the locking member of the movable hook are linked to each other via the hydraulic cylinder for moving the movable hook; therefore, if the biasing member of the movable hook breaks, the retaining function of the locking member is canceled not only on the movable hook side but also on the fixed hook side. At this point in time, if the supply of hydraulic pressure to the hydraulic cylinder is cut off, there arises a problem that the attachment may be disengaged. In this manner, in the known attachment mounting and demounting apparatus, there is room for improvement to prevent the disengagement of the attachment and improve safety.

The present disclosure has been made in view of the above problem, and an object thereof is to provide a construction machine attachment mounting and demounting apparatus capable of maintaining a coupled state of an attachment and achieving a high level of safety even when power supply to a hydraulic cylinder is cut off, and a construction machine quipped with the same.

Solution to Problem

A construction machine attachment mounting and demounting apparatus according to the present disclosure is a construction machine attachment mounting and demounting apparatus that mounts and demounts an attachment for work on and from an arm of a working device, the attachment mounting and demounting apparatus including: a first member that has a first hook and is coupled to the arm; a second member that has a second hook and is rotatably supported by the first member; a first hydraulic cylinder that has one end coupled to a first support shaft provided to the first member, and the other end coupled to a second support shaft provided to the second member, and rotates the second member relative to the first member; a first retaining member that is rotatably supported by a third support shaft provided to the first member, the third support shaft being placed above the first hook, and is biased by a first biasing member in such a manner as to protrude from an opening portion of the first hook; a second hydraulic cylinder that moves the first retaining member against the biasing force of the first biasing member in such a manner as to retract the first retaining member from the opening portion of the first hook in conjunction with the operation of the first hydraulic cylinder; a second retaining member that is rotatably supported by a fourth support shaft provided to the second member, the fourth support shaft being placed above the second hook, and is biased by a second biasing member in such a manner as to protrude from an opening portion of the second hook; and a third hydraulic cylinder that moves the second retaining member against the second biasing member in such a manner as to retract the second retaining member from the opening portion of the second hook in conjunction with the operation of the first hydraulic cylinder.

Moreover, a construction machine attachment mounting and demounting apparatus according to another aspect of the present disclosure is configured in such a manner that in the construction machine attachment mounting and demounting apparatus, the second hydraulic cylinder is placed between the first support shaft and the third support shaft, and the third hydraulic cylinder is placed between the second support shaft and the fourth support shaft.

Moreover, a construction machine attachment mounting and demounting apparatus according to another aspect of the present disclosure is configured in such a manner that in the construction machine attachment mounting and demounting apparatus, a distance between shaft centers of the first support shaft and the second support shaft is less than a distance between shaft centers of the third support shaft and the fourth support shaft.

Moreover, a construction machine attachment mounting and demounting apparatus according to another aspect of the present disclosure is configured in such a manner that in the construction machine attachment mounting and demounting apparatus, a distance between shaft centers of a fifth support shaft that supports the second hydraulic cylinder and a sixth support shaft that supports the third hydraulic cylinder is less than a distance between shaft centers of the third support shaft and the fourth support shaft.

Moreover, a construction machine attachment mounting and demounting apparatus according to another aspect of the present disclosure is configured in such a manner that in the construction machine attachment mounting and demounting apparatus, upon a rod of the first hydraulic cylinder being maximally extended, a distal end of the second hook is forward of the fourth support shaft.

Moreover, a construction machine attachment mounting and demounting apparatus according to another aspect of the present disclosure is configured in such a manner that in the construction machine attachment mounting and demounting apparatus, the first hydraulic cylinder is a double-acting hydraulic cylinder, the second hydraulic cylinder and the third hydraulic cylinder are single-acting hydraulic cylinders, and a branch block is provided in the first member to cause pressure oil to branch into a path in which pressure oil for causing the rod of the first hydraulic cylinder to contract is supplied to one of cylinder chambers of a cylinder tube and, simultaneously, pressure oil for causing rods of the second hydraulic cylinder and the third hydraulic cylinder to extend is supplied to the second hydraulic cylinder and the third hydraulic cylinder, and a path in which pressure oil for causing the rod of the first hydraulic cylinder to extend is supplied to the other cylinder chamber of the cylinder tube.

Moreover, a construction machine attachment mounting and demounting apparatus according to another aspect of the present disclosure is configured in such a manner that in the construction machine attachment mounting and demounting apparatus, the branch block is placed above the cylinder tube of the first hydraulic cylinder.

Moreover, a construction machine attachment mounting and demounting apparatus according to another aspect of the present disclosure is configured in such a manner that in the construction machine attachment mounting and demounting apparatus, an end of the rod of each of the second hydraulic cylinder and the third hydraulic cylinder has a hemispherical shape, and protrudes further than an end of a respective cylinder tube thereof during contraction of the second hydraulic cylinder and the third hydraulic cylinder.

A construction machine according to the present disclosure is configured in such a manner as to include: the construction machine attachment mounting and demounting apparatus; a travel device; and a front working device that is provided on a front side of the travel device and has the arm that causes the attachment mounting and demounting apparatus to detachably support the attachment.

Advantageous Effects of Invention

According to the present disclosure, it is possible to maintain a coupled state of an attachment and to achieve a high level of safety even when power supply to a hydraulic cylinder is cut off.

DESCRIPTION OF EMBODIMENTS

The present disclosure relates to an attachment mounting and demounting apparatus for mounting and demounting an attachment for work on and from an arm in a front working device of a construction machine, and aims to improve safety by devising, for example, a configuration for operating a hook on a movable side. An embodiment of the present disclosure is described hereinafter with reference to the drawings.

In the embodiment, a description is given, taking an excavation work machine that is a swing work vehicle as an example of a construction machine according to the present disclosure. However, the construction machine according to the present disclosure is not limited to the excavation work machine, and can also be widely applied to other construction machines such as a crane work machine and a wheel loader.

Firstly, an overall configuration of an excavation work machine 1 according to the embodiment is described with reference to FIG. 1. Note that unless direction vision is otherwise specified, the terms "front side," "back side," "left and right sides," "planar side" or "upper side," and "bottom side" or "lower side" are used below, relative to the position of an operator seated in an operator's seat of the excavation work machine 1.

Figure 1:
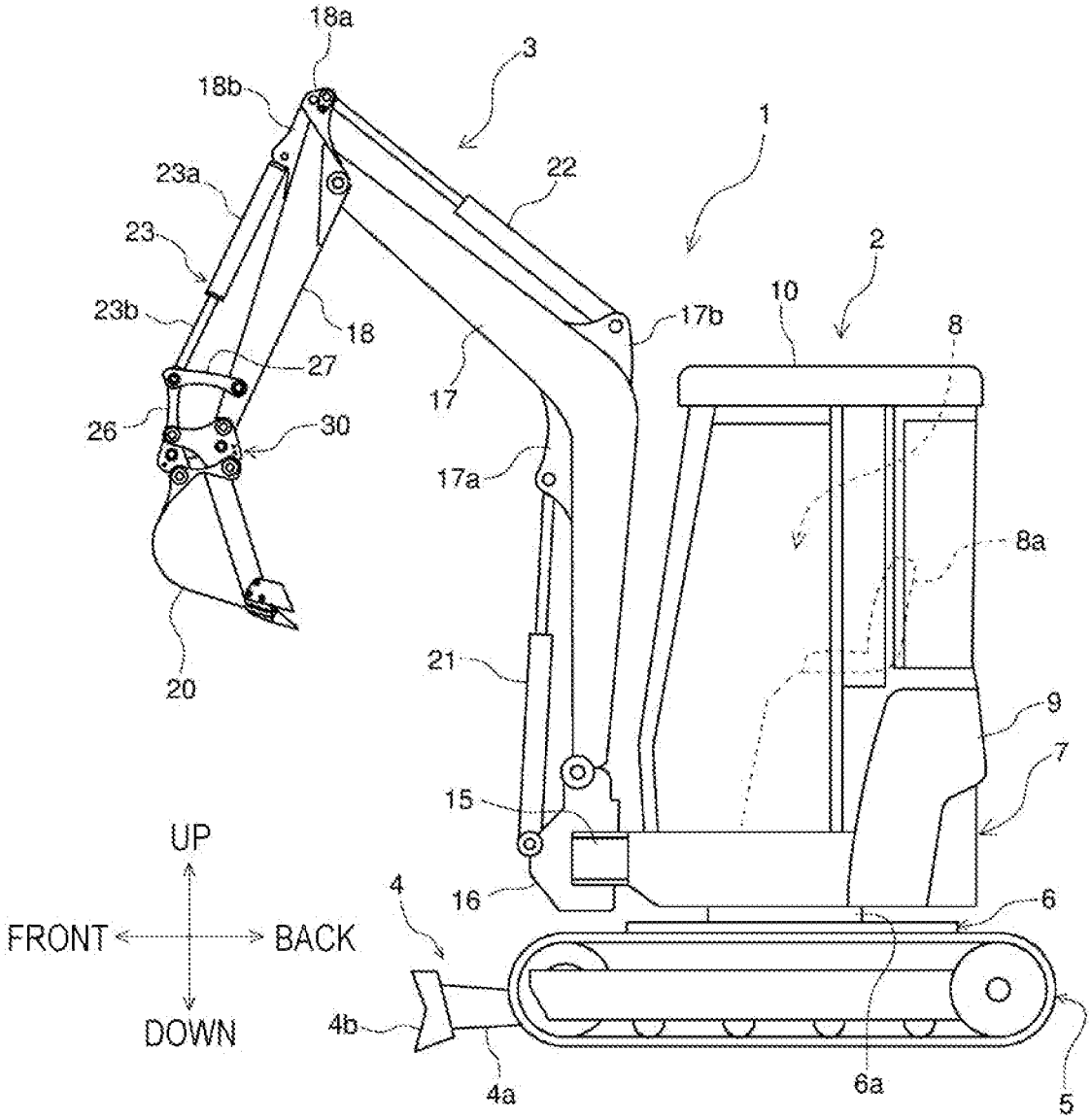
FIG. 1 is a left side view of an excavation work machine according to an embodiment of the present disclosure.

As illustrated in FIG. 1, the excavation work machine 1 includes a travel device 2 as a self-propelled travel vehicle body, and an excavation device 3 and a soil removing device 4 as working units attached to the travel device 2.

The travel device 2 is a part constituting a base machine of the excavation work machine 1, and includes a pair of left and right crawler travel units 5, a base machinery frame 6 as a base interposed between the left and right travel units 5, and a rotating platform 7 provided on the base machinery frame 6. The rotating platform 7 has an approximately circular shape in plan view, and is provided in such a manner as to be rotatable both to the left and to the right about an axis in the up-and-down direction by a rotation support portion 6*a* provided on the base machinery frame 6.

An operator's section 8 is provided on the rotating platform 7. Moreover, a motor unit 9 in which, for example, an engine is covered with, for example, a hood is provided in the back part on the rotating platform 7.

The operator's section 8 is for driving and operating the travel device 2, the excavation device 3, and the soil removing device 4, and is provided in a cabin 10 provided on the rotating platform 7. The cabin 10 includes a frame that forms its outer shape, and a plurality of window portions made of a transparent member such as glass, and is, as a whole, in the form of an approximately box shape.

In the operator's section 8, an operator's seat support base is provided on a floor portion, and an operator's seat 8*a* is provided on the operator's seat support base. The operator's section 8 is provided with, for example, a pair of left and right travel levers extending upward from the floor portion, and an operating pedal for work placed on the floor portion. Moreover, in the operator's section 8, for example, a work operating lever for operating a working unit (the excavation device 3 or the soil removing device 4), and an operating panel unit including various operating units such as a switch for switching the operating state of an attachment mounting and demounting apparatus 30 are provided around the operator's seat 8*a*.

The proximal end of the excavation device 3 is attached in the middle in the left-and-right direction at the front end of the rotating platform 7. Moreover, the soil removing device 4 is attached at the front of the base machinery frame 6. The soil removing device 4 includes a support frame 4*a* extending in the front-and-back direction between the left and right travel units 5, and a blade 4*b* as a blade provided at the distal end of the support frame 4*a*. The soil removing device 4 is provided in such a manner as to be capable of being raised and lowered and rotated by a cylinder mechanism provided between the support frame 4*a* and the base machinery frame 6.

In the excavation work machine 1 including the above configuration, an operator seated in the operator's seat 8*a* operates, for example, the travel levers and/or the work operating lever as appropriate to perform desired actions and operations. Specifically, for example, the travel lever is operated to cause the travel device 2 to travel forward/backward in a straight line or to travel, turning to the left/right. Moreover, the work operating lever is operated to cause the excavation device 3 to perform excavation work, or to cause the soil removing device 4 to perform soil discharging work and/or grading work.

Figure 2:
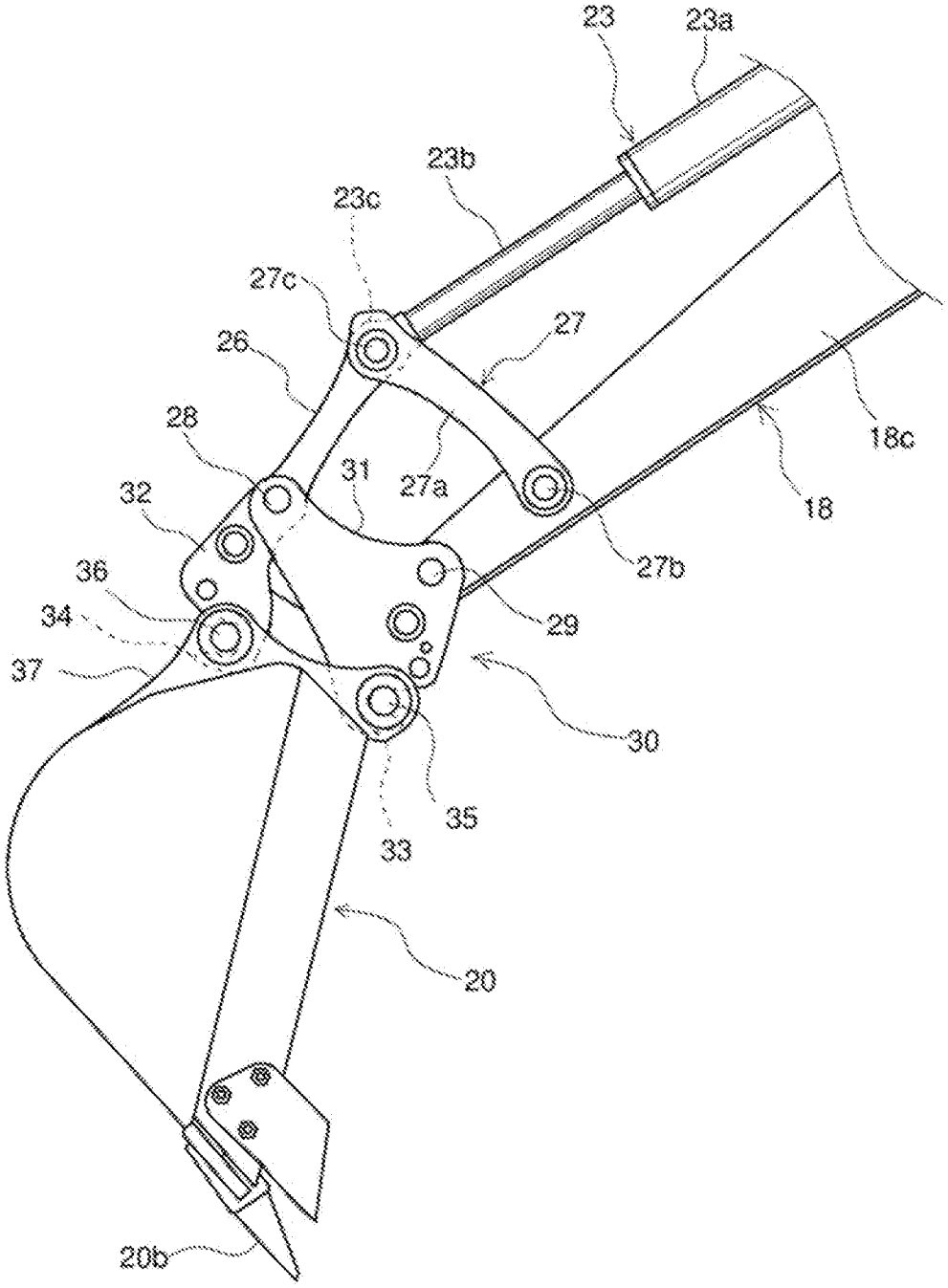
FIG. 2 is a left side view illustrating a part of an excavation device according to an embodiment of the present disclosure.

The excavation device 3 is described with reference to FIGS. 1 to 3. The excavation device 3 is a front working device that is provided at the front of the travel device 2. A support bracket 15 protrudes forward in the middle in the left-and-right direction at the front end of the rotating platform 7, and the proximal end portion of the excavation device 3 is attached to the support bracket 15. The excavation device 3 includes a boom support bracket 16 as a member that forms the proximal end portion thereof. The excavation device 3 causes the support bracket 15 of the base machine to support the boom support bracket 16 in such a manner as to be rotatable about the up-and-down direction as its rotation axis direction.

The excavation device 3 is provided in such a manner that a swing cylinder (not illustrated) placed on the right side of the boom support bracket 16 swings to the left and to the right relative to the rotating platform 7. The swing cylinder is provided between the boom support bracket 16 and the rotating platform 7.

The excavation device 3 includes a boom 17 constituting a portion on the base side of the excavation device 3, an arm 18 coupled to the distal end of the boom 17, and a bucket 20 attached to the distal end of the arm 18. The excavation device 3 includes a boom cylinder 21 that causes the boom 17 to perform a rotating action, an arm cylinder 22 that causes the arm 18 to perform the rotating action, and a working tool cylinder 23 that causes the bucket 20 to perform the rotating action.

The boom 17 has a boomerang-like bent shape in side view. The proximal end of the boom 17 is supported in such a manner as to be rotatable about the left-and-right direction as its rotation axis direction relative to the boom support bracket 16. The boom cylinder 21 is placed forward of the boom 17 in the standing state, and runs between the boom support bracket 16 and a bracket 17*a* protruding from the inner side of the bent portion of the boom 17. When the boom cylinder 21 extends and contracts, the boom 17 performs the rotating action relative to the boom support bracket 16.

The distal end of the boom 17 is coupled to the proximal end of the arm 18 in such a manner as to be rotatable about the left-and-right direction as its rotation axis direction. The arm cylinder 22 is placed on the upper side (back side) of the boom 17 in the standing state, and runs between a bracket 17*b* protruding from the outer side of the bent portion of the boom 17 and an end at the back of a back bracket 18*a* protruding from the back end of the arm 18. When the arm cylinder 22 extends and contracts, the arm 18 performs the rotating action relative to the boom 17.

The bucket 20 is coupled to the distal end of the arm 18 via the attachment mounting and demounting apparatus 30. In other words, the attachment mounting and demounting apparatus 30 is coupled to the distal end of the arm 18, and is detachably coupled to the bucket 20.

The working tool cylinder 23 is placed forward (on the back side) of the arm 18 that is suspended from the upper end of the boom 17. The working tool cylinder 23 includes a cylinder 23*a* and a cylinder rod 23*b* that has a piston on one end side and is slidably provided in the cylinder 23*a* via the piston. The working tool cylinder 23 includes a bottom (the cylinder 23*a*)-side end that is an end on one side and is supported by a front bracket 18*b* in such a manner as to be rotatable about the left-and-right direction as its rotation axis direction. The front bracket 18*b* protrudes from the front side of the back bracket 18*a* at the back end of the arm 18.

On the other hand, a rod (the cylinder rod 23*b*)-side end that is an end on the other side of the working tool cylinder 23 is coupled to the attachment mounting and demounting apparatus 30 via a first link 26. Moreover, the rod-side end of the working tool cylinder 23 is supported by a portion in the vicinity of the distal end of the arm 18 via a second link 27.

The second link 27 includes a pair of left and right link arms 27*a*, a base-side support shaft 27*b* that runs between one ends of the pair of link arms 27*a*, and a distal end-side support shaft 27*c* that runs between the other ends of the pair of link arms 27*a*. The second link 27 is supported by the base-side support shaft 27*b* in such a manner as to be rotatable relative to the arm 18.

The link arm 27*a* is formed by an arm-like (longitudinal) plate-shaped member of which thickness direction is the left-and-right direction. The one ends of the pair of link arms 27*a* are located outward of left and right side portions 18*c* of the arm 18 in the left-and-right direction. The pair of link arms 27*a* is supported by the base-side support shaft 27*b* penetrating the vicinity of the distal end of the arm 18 in the left-and-right direction in such a manner as to be rotatable relative to the arm 18.

The distal end of the cylinder rod 23*b* of the working tool cylinder 23 is rotatably supported by the distal end-side support shaft 27*c*. The distal end of the cylinder rod 23*b* is provided with a boss portion 23*c* through which the distal end-side support shaft 27*c* passes. Moreover, one end side (the back end side) of the first link 26 is rotatably supported by the distal end-side support shaft 27*c*. The first link 26 bifurcates into a left and a right part at one end. Each of the left and right ends is provided with a boss portion 26*a* through which the distal end-side support shaft 27*c* passes. The boss portion 23*c* of the cylinder rod 23*b* is located on the distal end-side support shaft 27*c* between the left and right boss portions 26*a* of the first link 26.

The other end side (front end side) of the first link 26 is coupled to a predetermined position of the attachment mounting and demounting apparatus 30 by a link support shaft 28 provided with the left-and-right direction as its axial direction in such a manner as to be rotatable relative to the attachment mounting and demounting apparatus 30. The distal end of the arm 18 is coupled to a position, which is different from the position of placement of the link support shaft 28, of the attachment mounting and demounting apparatus 30 by an arm support shaft 29 provided with the left-and-right direction as its axial direction, in such a manner as to be rotatable relative to the attachment mounting and demounting apparatus 30.

In such a configuration, the extension and contraction actions of the working tool cylinder 23 allow the attachment mounting and demounting apparatus 30 to rotate about the arm support shaft 29 as its axis of rotation in step with the rotating actions of the first link 26 and the second link 27. In step with this, the bucket 20 rotates integrally with the attachment mounting and demounting apparatus 30.

In the excavation device 3 having the above configuration, the bucket 20, as the attachment for work, is detachably mounted on the arm 18 by the attachment mounting and demounting apparatus 30. Another device such as a grapple or a breaker is mounted as the attachment for work instead of the bucket 20, according to the work content of the excavation work machine 1. In this manner, the excavation device 3 includes the arm 18 that supports the attachment for work in such a manner that the attachment mounting and demounting apparatus 30 can mount and demount the attachment for work. An attachment that fits a work content is mounted on the arm 18 via the attachment mounting and demounting apparatus 30 provided at the distal end of the arm 18.

The coupling between the attachment mounting and demounting apparatus 30 and the bucket 20 is described. The attachment mounting and demounting apparatus 30 is an apparatus that mounts and demounts the bucket 20 of the excavation work machine 1 on and from the arm 18 of the excavation device 3.

Figure 3:
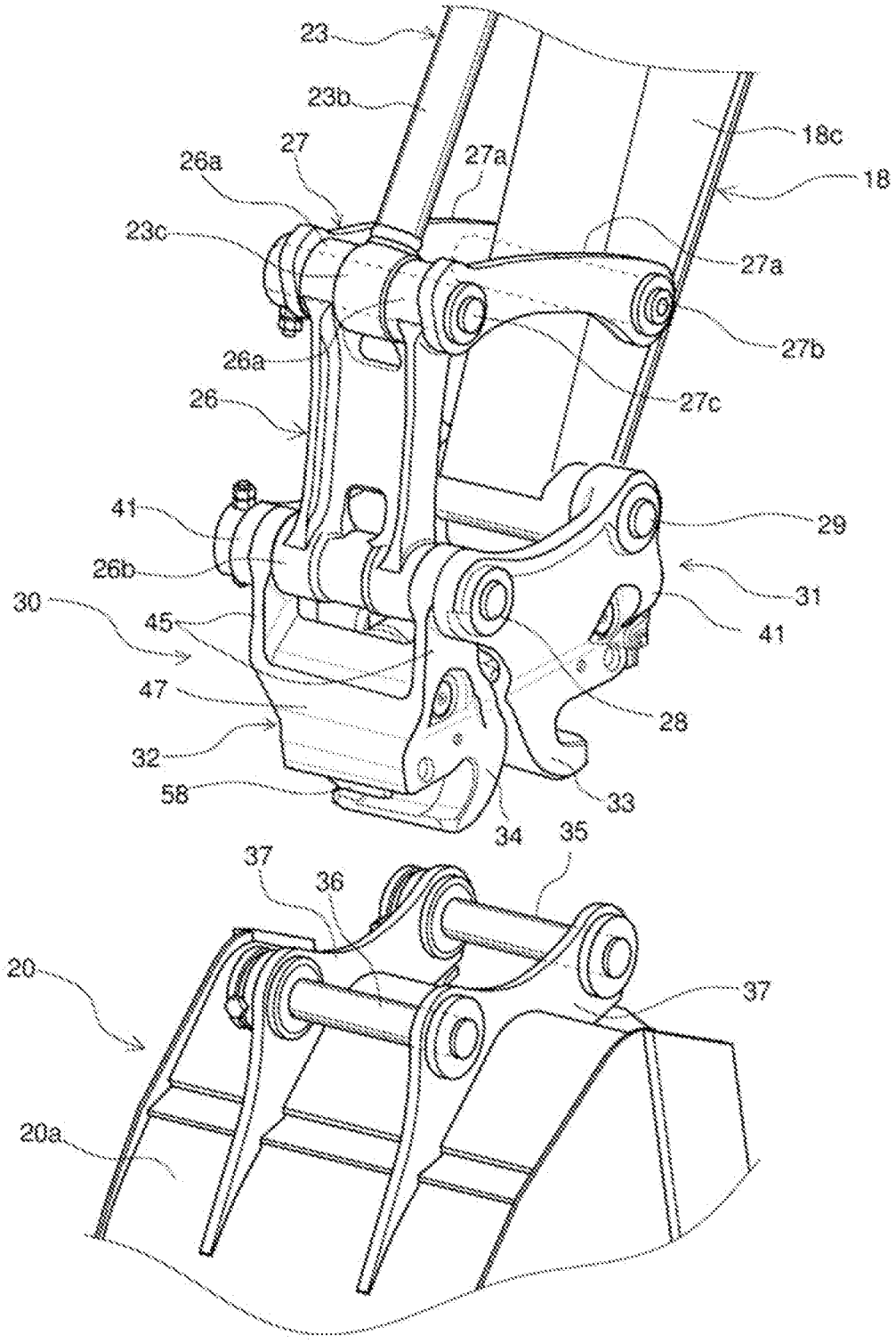
FIG. 3 is a perspective view illustrating an attachment mounting and demounting apparatus and a bucket in its removed state according to an embodiment of the present disclosure.

As illustrated in FIG. 3, the attachment mounting and demounting apparatus 30 is coupled to the bucket 20 by engaging a first hook 33 and a second hook 34 with a back support pin 35 and a front support pin 36 of the bucket 20, respectively.

The front support pin 36 and the back support pin 35 are straight rod-like members of which the axial direction is the left-and-right direction, and run between a pair of left and right support rib portions 37 that protrudes from a back portion 20*a* of the bucket 20, spaced a predetermined distance apart from each other in the left-and-right direction. The support rib portions 37 are plate-shaped projection portions of which thickness direction is the left-and-right direction.

The left and right support rib portions 37 support the front support pin 36 and the back support pin 35 at positions spaced a predetermined distance apart from each other. Two ends of each of the front support pin 36 and the back support pin 35 penetrate the left and right support rib portions 37, and the left and right support rib portions 37 support these support pins in a fixed state. The left and right support rib portions 37 are provided on portions on the base side (the upper side in FIG. 3) of the back portion 20*a* of the bucket 20. Note that a plurality of tooth portions 20*b* is provided at the distal end of the back portion 20*a* of the bucket 20 at predetermined intervals in the left-right direction (refer to FIG. 2).

The configuration of the attachment mounting and demounting apparatus 30 is described with reference to FIGS. 4 to 13. The attachment mounting and demounting apparatus 30 includes a fixed frame 31 as a first member having the first hook 33 in a lower part thereof, and a movable frame 32 as a second member having the second hook 34 in a lower part thereof. The attachment mounting and demounting apparatus 30 as a whole is configured in such a manner as to be substantially symmetrical in the left-and-right direction.

The fixed frame 31 is a portion of the attachment mounting and demounting apparatus 30 that is coupled to the arm 18 of the excavation device 3. The fixed frame 31 is supported by the arm support shaft 29 in such a manner as to be rotatable relative to the arm 18.

The arm support shaft 29 is rotatably supported at the distal end of the arm 18, penetrating the arm 18 in the left-and-right direction.

The fixed frame 31 includes side wall frame portions 41 as a pair of left and right wall portions, and a back wall portion 44. Each of the left and right side wall frame portions 41 is a plate-shaped portion of which the thickness direction is the left-and-right direction, and has an approximately inverted trapezoidal outer shape having a concave upper side and also has a shape tapered from the back toward the front, in side view. The back wall portion 44 is at the back ends of the side wall frame portions 41 and runs between the left and right side wall frame portions 41. The length of the back wall portion 44 in the up-and-down direction is less than the length of the side wall frame portions 41 in the up-and-down direction. A backward opening is formed by the back ends of the left and right side wall frame portions 41 and the upper end of the back wall portion 44. A cover plate 51 for preventing ingress of, for example, earth and sand into the attachment mounting and demounting apparatus 30 is provided behind the left and right side wall frame portions 41 in such a manner as to cover the backward opening.

The upper back portions of the side wall frame portions 41 include hole portions into which the ends of the arm support shaft 29 protruding to the left and right sides from the distal end of the arm 18 are inserted and which support the ends, respectively. The side wall frame portions 41 are coupled to the arm support shaft 29 in such a manner as not to be rotatable relative to the arm support shaft 29, and rotate integrally with the arm support shaft 29 relative to the arm 18. The right side wall frame portion 41 is provided on its outer side with a cylindrical boss portion 41*a* for the hole portion into which the arm support shaft 29 is inserted. The fixed frame 31 and the arm support shaft 29 are coupled by, for example, a coupling bolt 42 that penetrates the boss portion 41*a* and the arm support shaft 29 in the radial direction, and a nut 42*a*.

The upper front portions of the side wall frame portions 41 include hole portions into which the left and right ends of the link support shaft 28 are inserted and which support the ends, respectively. The left and right side wall frame portions 41 are coupled to the link support shaft 28 in such a manner as not to be rotatable relative to the link support shaft 28, and rotate integrally with the link support shaft 28 relative to the first link 26. The right side wall frame portion 41 is provided on its outer side with a cylindrical boss portion 41*b* for the hole portion into which the link support shaft 28 is inserted. The side frame portions 41 and the link support shaft 28 are coupled by, for example, a coupling bolt 43 that penetrates the boss portion 41*b* and the link support shaft 28 in the radial direction, and a nut 43*a*.

The first hook 33 is provided below the side wall frame portions 41. The first hook 33 is provided, as a portion having a predetermined thickness in the left-and-right direction, inward of the side wall frame portions 41 in the left-and-right direction. The first hook 33 includes a latch portion 46 extending in a curved manner in such a manner as to have a hook shape in side view.

The latch portion 46 includes an engagement surface 46*a* having a concave shape that is open at the back in side view. The engagement surface 46*a* of the latch portion 46 is a portion that comes into contact with the back support pin 35 of the bucket 20.

A back locking member 48 described below is provided above the latch portion 46 of the first hook 33 in such a manner as to face the engagement surface 46*a*. The back locking member 48 is configured in such a manner as to be capable of extending toward and retracting from an opening portion 46*b* of the latch portion 46.

Hole portions into which the left and right ends of a bottom-side support shaft 81 described below are inserted and which support the ends are provided between the hole portions of the side wall frame portions 41 into which the arm support shaft 29 is inserted and the first hook 33. The right and left side wall frame portions 41 are provided on their inner sides with cylindrical boss portions 41*c* for the hole portions into which the bottom-side support shaft 81 is inserted. The side wall frame portions 41 and the bottom-side support shaft 81 are coupled by a set screw 81*a* that penetrates the boss portion 41*c* and is threadedly engaged into a screw hole 81*b* (refer to FIG. 7) provided in the peripheral surface of the bottom-side support shaft 81.

The first hook 33 is provided integrally with the left and right side wall frame portions 41, the back wall portion 44, and the boss portions 41*c* by, for example, casting.

The movable frame 32 is rotatably provided to the fixed frame 31, and includes the second hook 34 that engages with the front support pin 36 of the bucket 20 in the lower part of the movable frame 32. The movable frame 32 includes mounting frame portions 45 as a pair of left and right wall portions, and a front wall portion 47. Moreover, the second hook 34 runs between left and right mounting frame portions 45.

The mounting frame portions 45 are portions used to rotatably mount the movable frame 32 on the fixed frame 31. Each of the left and right mounting frame portions 45 is a plate-shaped wall portion of which the thickness direction is the left-and-right direction, and has an approximately triangular outer shape and also has a shape tapered from the lower side toward the upper side, in side view. The mounting frame portions 45 form a frame body including a pair of left and right plate-shaped wall portions.

Hole portions through which the link support shaft 28 can be inserted are provided in the upper parts of the mounting frame portions 45. The mounting frame portions 45 are located inward of the side wall frame portions 41 in the left-and-right direction, and each include an upper end that matches a circular shape, the upper end coinciding, in side view, with the position in which the hole portion is formed in the front side of the respective side wall frame portion 41.

As illustrated in FIG. 3, the link support shaft 28 passes, in the left-right direction, through boss portions 26*b* provided at the other end of the first link 26 that is connected at the one end to the second link 27, and the left and right ends of the link support shaft 28 are inserted into the hole portions in the upper front sides of the side wall frame portions 41 and the hole portions in the upper sides of the mounting frame portions 45. The mounting frame portions 45 are rotatably coupled to the link support shaft 28 that is fixed to the side wall frame portions 41 as described above; therefore, the movable frame 32 is rotatably provided to the fixed frame 31.

The second hook 34 is provided, as a portion having a predetermined thickness in the left-and-right direction, inward of the mounting frame portions 45 in the left-and-right direction. The second hook 34 includes a latch portion 49 extending in a curved manner in such a manner as to have a hook shape in side view as in the first hook 33.

The latch portion 49 includes an engagement surface 49*a* having a concave shape that is open at the front in side view. The engagement surface 49*a* of the latch portion 49 is a portion that comes into contact with the front support pin 36 of the bucket 20.

A front locking member 58 described below is provided above the latch portion 49 of the second hook 34 in such a manner as to face the engagement surface 49*a*. The front locking member 58 is configured in such a manner as to be capable of extending toward and retracting from an opening portion 49*b* of the second hook 34 that is open to the front.

The second hook 34 is provided integrally with the left and right mounting frame portions 45 and the front wall portion 47 by, for example, casting.

Hole portions into which the left and right ends of a rod-side support shaft 82 described below are inserted and which support the ends are provided between the hole portions on the upper sides of the mounting frame portions 45 and the second hook 34. The left and right mounting frame portions 45 are provided on their inner sides with cylindrical boss portions 45*a* for the hole portions into which the rod-side support shaft 82 is inserted (refer to FIG. 5). The mounting frame portions 45 and the rod-side support shaft 82 are coupled by a set screw 82*a* that penetrates the boss portion 45*a* and is threadedly engaged into a screw hole 82*b* (refer to FIG. 7) provided in the peripheral surface of the rod-side support shaft 82.

The attachment mounting and demounting apparatus 30 includes a first hydraulic cylinder 55 that rotates the movable frame 32 relative to the fixed frame 31. The first hydraulic cylinder 55 performs the extension and contraction actions to rotate the movable frame 32 forward and backward about the axis of the link support shaft 28.

In the attachment mounting and demounting apparatus 30, the first hydraulic cylinder 55 is provided in the middle in the left-and-right direction in an orientation in which the extension/contraction direction is the front-and-back direction in plan view. The first hydraulic cylinder 55 includes a cylinder tube 61, and a piston rod 62 provided in such a manner as to be slidable relative to the cylinder tube 61, and extends and contracts on the basis of the sliding action of the piston rod 62 relative to the cylinder tube 61. The piston rod 62 located in the cylinder tube 61 is provided at one end with a piston 63 that slides in the cylinder tube 61 (refer to FIG. 11).

Figure 11:
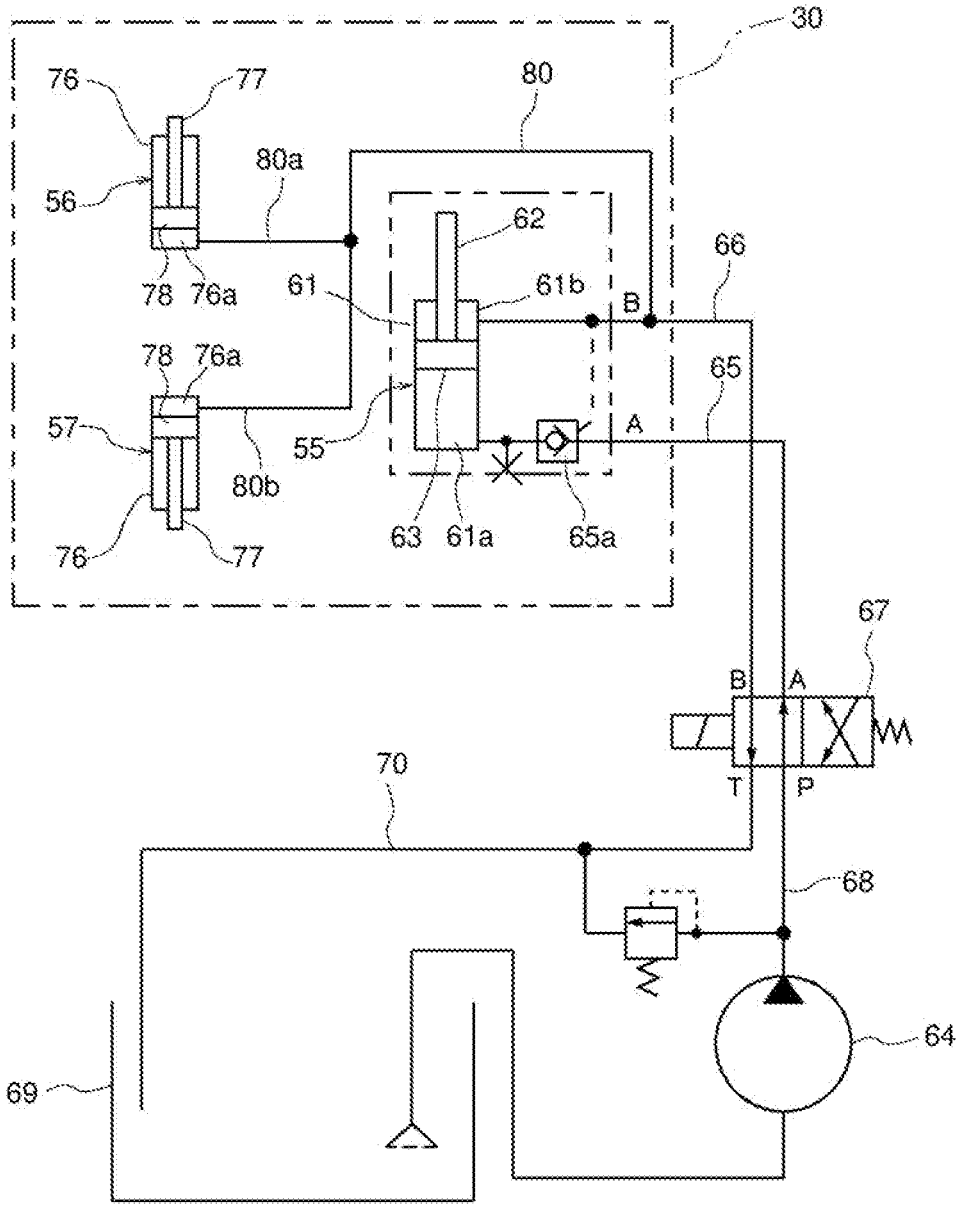
FIG. 11 is a circuit diagram illustrating a hydraulic circuit configuration of the attachment mounting and demounting apparatus according to an embodiment of the present disclosure.

As illustrated in FIG. 11, the first hydraulic cylinder 55 is a double-acting hydraulic cylinder, and the internal space of the cylinder tube 61 is partitioned by the piston 63 into a bottom-side chamber 61*a* that is a space in the back of the cylinder tube 61 (on the bottom side), and a rod-side chamber 61*b* that is a space around the piston rod 62 (on the rod side). The first hydraulic cylinder 55 moves the piston rod 62 relative to the cylinder tube 61 on the basis of supply and discharge of pressure oil to and from each of the bottom-side chamber 61*a* and the rod-side chamber 61*b* to extend and contract.

A support configuration of the first hydraulic cylinder 55 is described. The first hydraulic cylinder 55 is provided between the left and right side wall frame portions 41 of the fixed frame 31 and between the left and right mounting frame portions 45 of the movable frame 32. The first hydraulic cylinder 55 is provided, orienting the piston rod 62 forward. The movable frame 32 supports the piston rod 62, and the fixed frame 31 supports the cylinder tube 61. In other words, the movable frame 32 and the fixed frame 31 are coupled to each other by the first hydraulic cylinder 55.

The back side of the first hydraulic cylinder 55 is supported in such a manner as to be rotatable relative to the bottom-side support shaft 81 that is a first support shaft. The bottom-side support shaft 81 runs between the left and right side wall frame portions 41 with the left-and-right direction as its axial direction. The cylinder tube 61 is provided at the back end with an approximately cylindrical boss portion 61*d* having a hole portion through which the bottom-side support shaft 81 passes. The boss portion 61*d* is located in the middle of the bottom-side support shaft 81 in the axial direction, and is supported in such a manner as to be rotatable relative to the bottom-side support shaft 81. The left and right ends of the bottom-side support shaft 81 are supported, fitting in the hole portions provided respectively in the left and right side wall frame portions 41 of the fixed frame 31.

Figure 4:
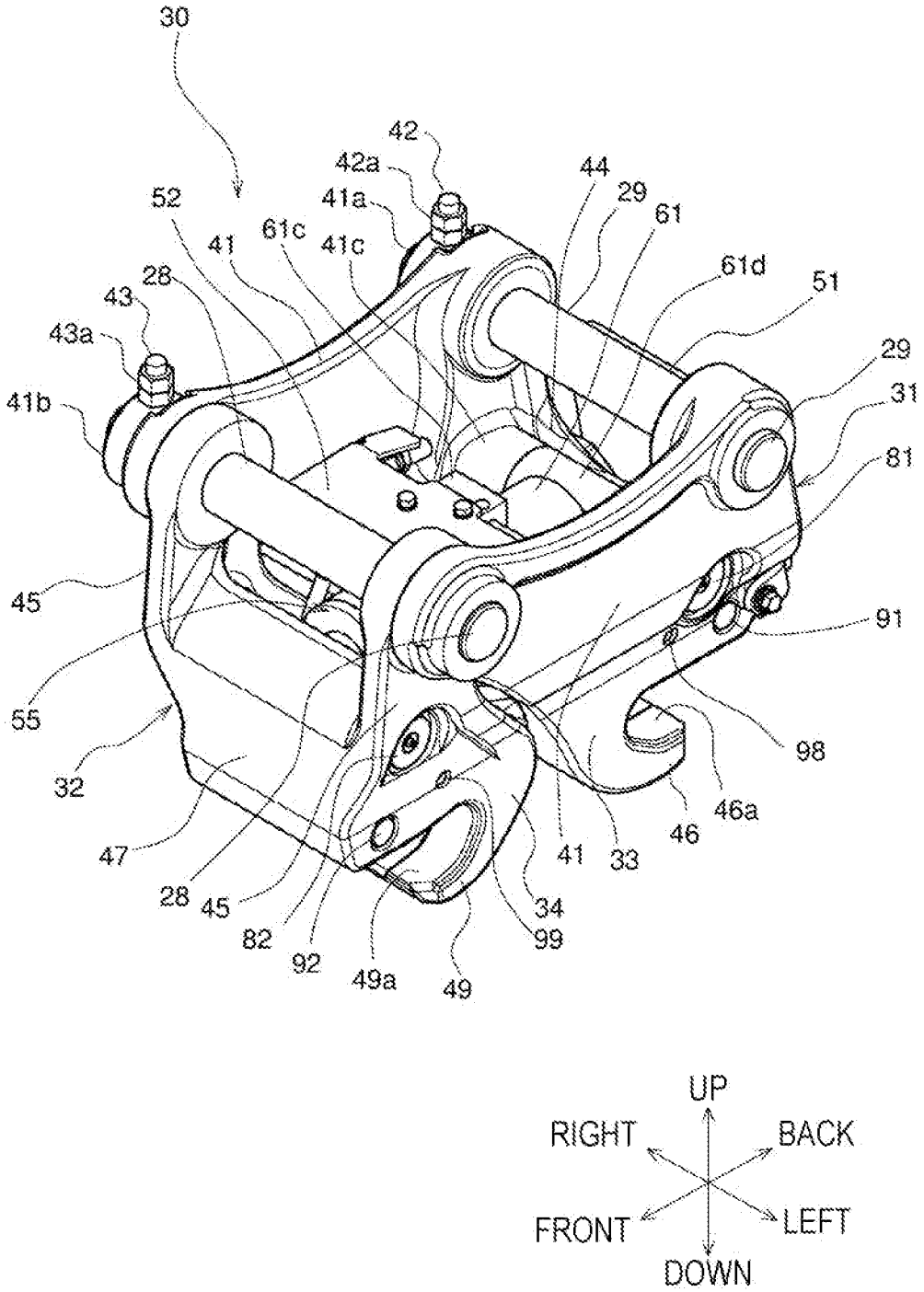
FIG. 4 is a perspective view of the attachment mounting and demounting apparatus according to an embodiment of the present disclosure.
Figure 5:
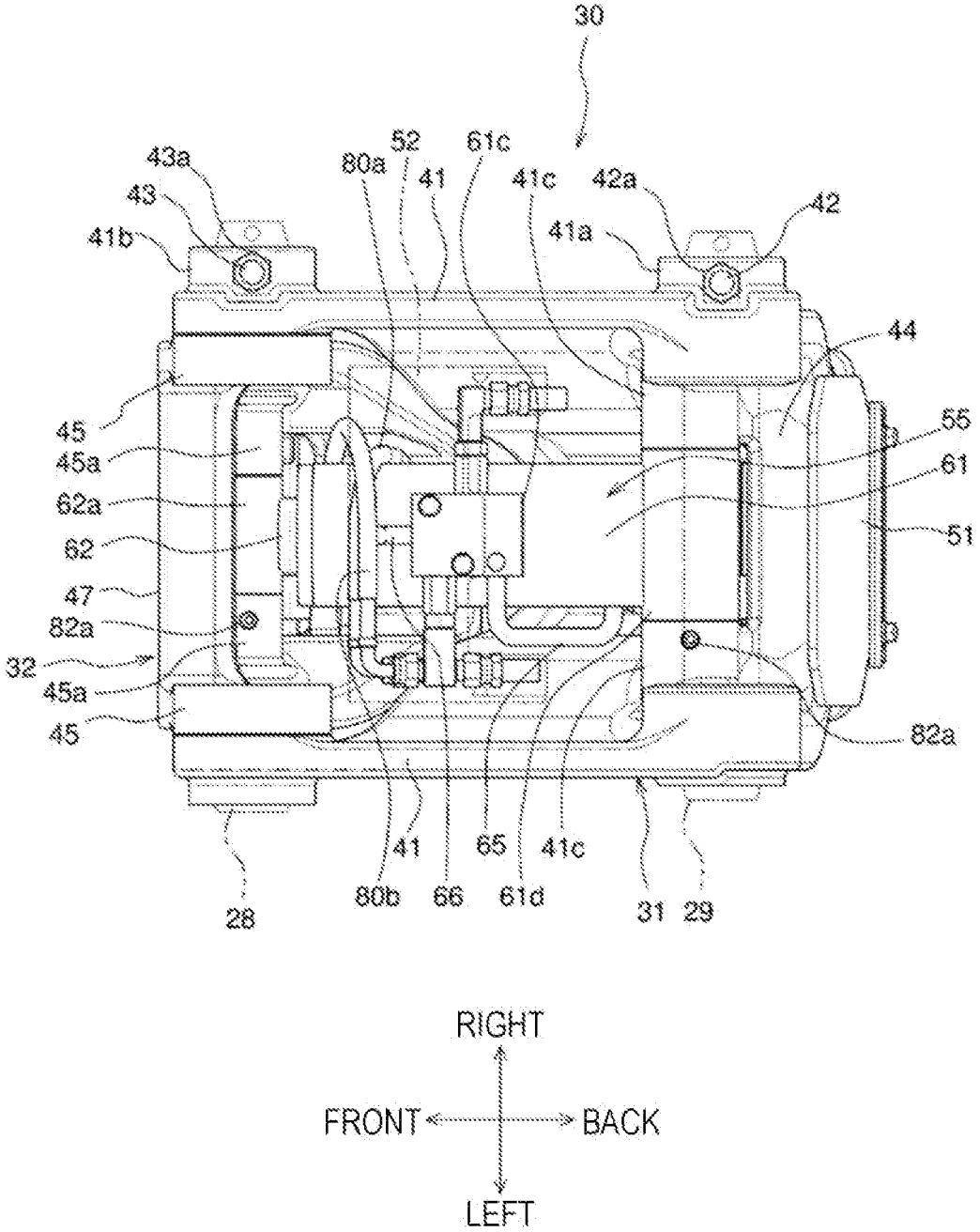
FIG. 5 is a plan view of the attachment mounting and demounting apparatus according to an embodiment of the present disclosure.
Figure 6:
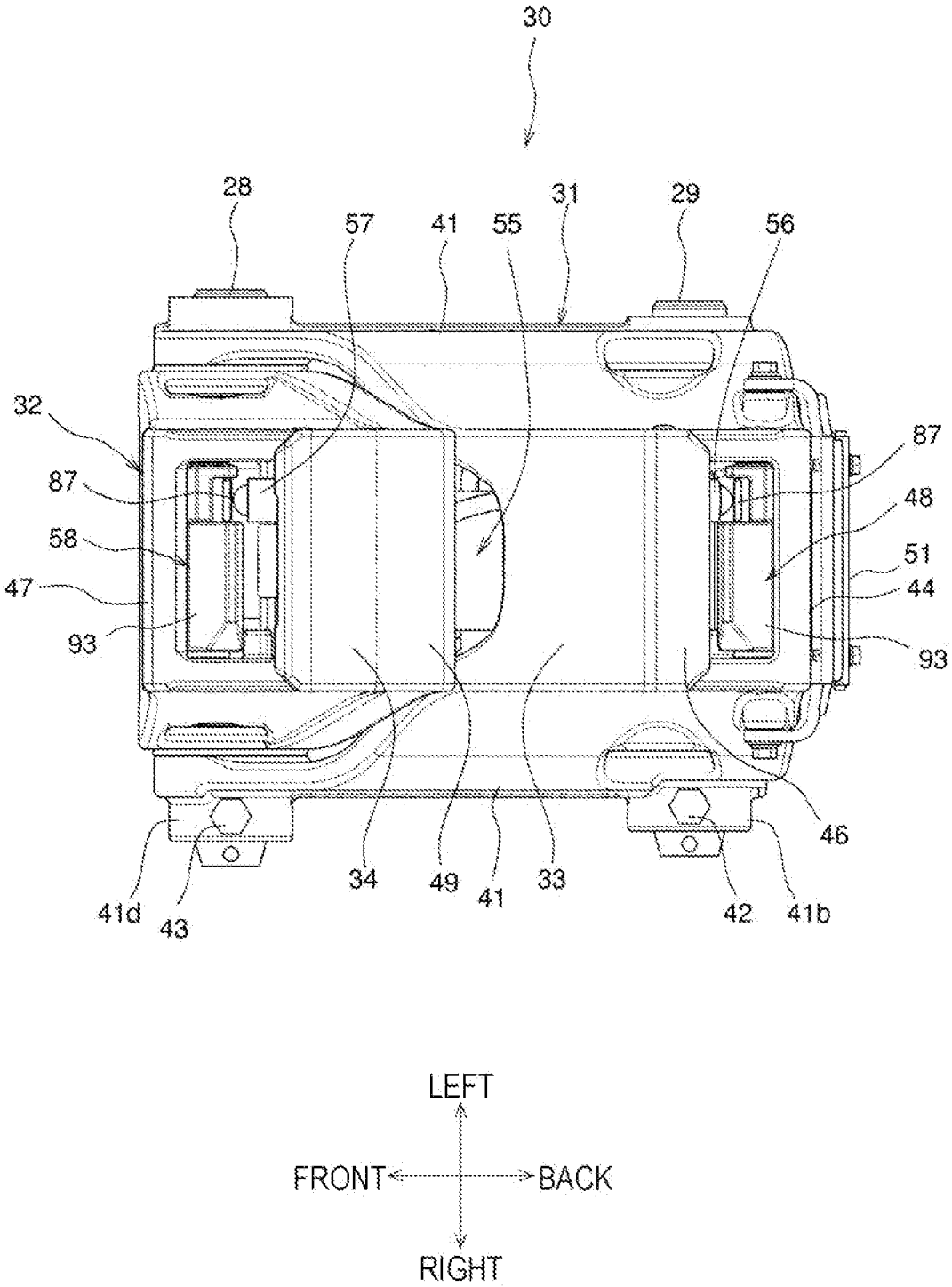
FIG. 6 is a bottom view of the attachment mounting and demounting apparatus according to an embodiment of the present disclosure.
Figure 7:
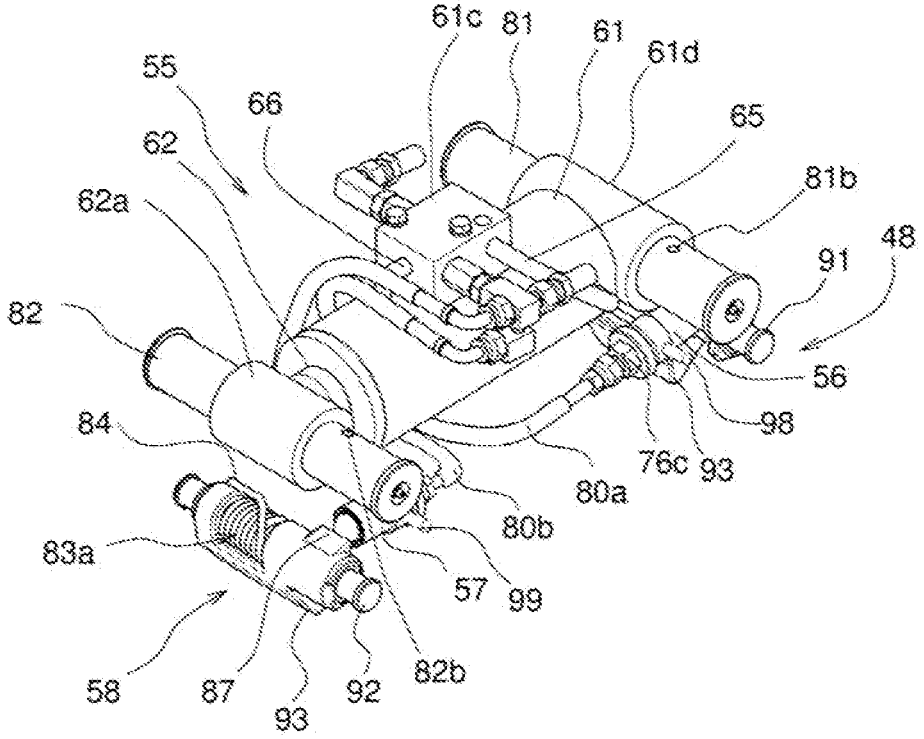
FIG. 7 is a perspective view illustrating an internal configuration of the attachment mounting and demounting apparatus according to an embodiment of the present disclosure.
Figure 8:
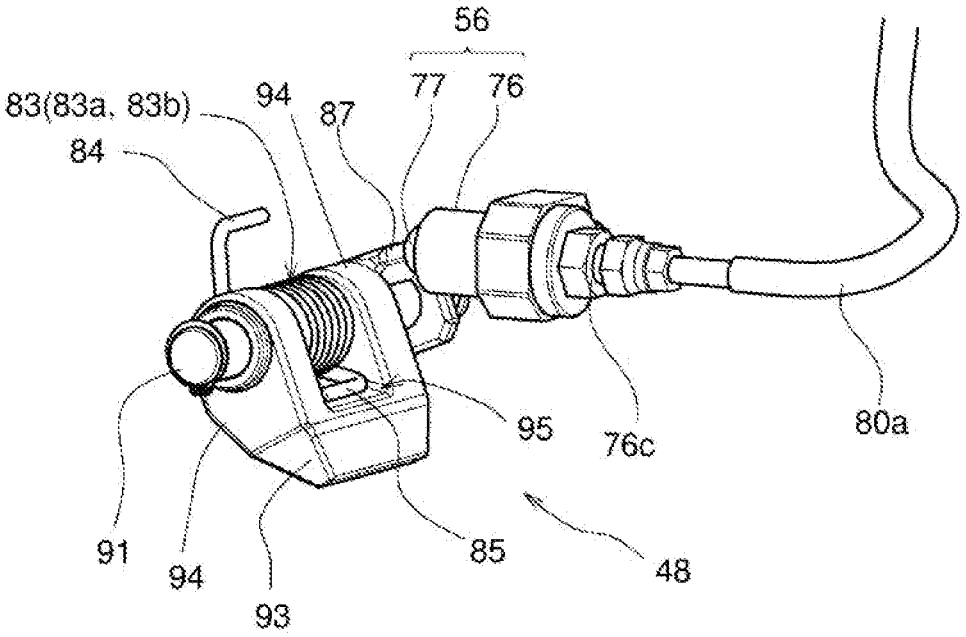
FIG. 8 is a perspective view illustrating a locking member of the attachment mounting and demounting apparatus according to an embodiment of the present disclosure in an enlarged manner.

Note that a branch block 61*c* is provided on top of the first hydraulic cylinder 55 (refer to FIGS. 5 and 7). Furthermore, as illustrated in FIG. 4, a cover plate 52 covers the branch block 61*c* from above. In the plan view of FIG. 5, the front support pin 36, the back support pin 35, and the cover plate 52 are indicated by alternate long and short dash lines for convenience.

The bottom-side support shaft 81 is fixed in the hole portions provided in the side wall frame portions 41 by, for example, the set screw 81*a* that penetrates the boss portion 41*c* and is screwed into the bottom-side support shaft 81 along its radial direction; therefore, the bottom-side support shaft 81 is supported in such a manner as not to be rotatable relative to the fixed frame 31. On the other hand, the cylinder tube 61 is supported in such a manner as to be rotatable relative to the bottom-side support shaft 81.

The front side of the first hydraulic cylinder 55 is supported in such a manner as to be rotatable relative to the rod-side support shaft 82 that is a second support shaft. The rod-side support shaft 82 runs between the left and right mounting frame portions 45 with the left-and-right direction as its axial direction. In other words, the rod-side support shaft 82 is provided parallel to the bottom-side support shaft 81. The piston rod 62 is provided at the distal end with an approximately cylindrical boss portion 62*a* having a hole portion through which the rod-side support shaft 82 passes. The boss portion 62*a* is located in the middle of the rod-side support shaft 82 in its axial direction, and is supported in such a manner as to be rotatable relative to the rod-side support shaft 82. The left and right ends of the rod-side support shaft 82 are supported, fitting in the hole portions provided respectively in the left and right mounting frame portions 45 of the movable frame 32.

The rod-side support shaft 82 is fixed in the hole portions provided in the mounting frame portions 45 by, for example, the set screw 82*a* that penetrates the boss portion 45*a* and is screwed into the rod-side support shaft 82 along is radial direction. Consequently, the rod-side support shaft 82 is supported in such a manner as not to be rotatable relative to the movable frame 32. The piston rod 62 is supported in such a manner as to be rotatable relative to the rod-side support shaft 82 inserted through the hole portion of the boss portion 62*a*.

According to the above support configuration of the first hydraulic cylinder 55, when the first hydraulic cylinder 55 extends and contracts, the rod-side support shaft 82 moves integrally with the piston rod 62 that moves relative to the cylinder tube 61 in step with the rotation of the first hydraulic cylinder 55 by the bottom-side support shaft 81. Consequently, the movable frame 32 rotates about the axis of the link support shaft 28 relative to the fixed frame 31 (refer to FIG. 13).

A configuration that rotates the back locking member 48 and the front locking member 58 is described.

The attachment mounting and demounting apparatus 30 includes, in the fixed frame 31, the back locking member 48 as a first retaining member, a second hydraulic cylinder 56, and a lock spring 83*a* as a first biasing member. Moreover, the attachment mounting and demounting apparatus 30 includes, in the movable frame 32, the front locking member 58 as a second retaining member, a third hydraulic cylinder 57, and a lock spring 83*b* as a second biasing member. The back locking member 48, the second hydraulic cylinder 56, and the lock spring 83*a* of the fixed frame 31, and the front locking member 58, the third hydraulic cylinder 57, and the lock spring 83*b* of the movable frame 32 are placed substantially mirror symmetrical in the front-and-back direction of the attachment mounting and demounting apparatus 30.

The members constituting the back locking member 48 and the front locking member 58 are members having the same shapes. The second hydraulic cylinder 56 and the third hydraulic cylinder 57 are single-acting cylinders of the same specification. Moreover, the lock spring 83*a* and the lock spring 83*b* are helical torsion springs of the same specification. The members are described in detail below. However, a description is given, assigning the same reference numerals to the common members. Moreover, unless the lock springs 83*a* and 83*b* are distinguished, they are described as the lock spring 83.

The back locking member 48 is a member that is rotatably provided to the fixed frame 31 and restricts detachment of the back support pin 35 engaged with the first hook 33 from the first hook 33. The back locking member 48 is supported by a back support shaft 91 as a third support shaft that runs between the left and right side wall frame portions 41 with the left-and-right direction as its axial direction in the fixed frame 31, in such a manner as to be rotatable relative to the fixed frame 31.

The back support shaft 91 is placed above the first hook 33. Two ends of the back support shaft 91 are supported at predetermined positions of the left and right side wall frame portions 41 to provide the back support shaft 91 parallel to the bottom-side support shaft 81. Therefore, hole portions that support the two ends of the back support shaft 91 are formed in the left and right side wall frame portions 41.

The front locking member 58 is a member that restricts detachment of the front support pin 36, which has been engaged with the second hook 34, from the second hook 34 in the movable frame 32. The front locking member 58 is supported by a front support shaft 92 as a fourth support shaft that runs between the left and right mounting frame portions 45 with the left-and-right direction as its axial direction in the movable frame 32, in such a manner as to be rotatable relative to the fixed frame 31.

The front support shaft 92 is placed above the second hook 34. Two ends of the front support shaft 92 are supported at predetermined positions of the left and right mounting frame portions 45 to provide the front support shaft 92 parallel to the rod-side support shaft 82. Therefore, hole portions that support the two ends of the front support shaft 92 are formed in the left and right mounting frame portions 45.

Each of the back locking member 48 and the front locking member 58 includes a lock pawl portion 93 that is a portion having a predetermined dimension in the left-and-right direction, and left and right support portions 94 that are portions supported by the back support shaft 91 or the front support shaft 92. The lock pawl portion 93 has a shape tapered toward one end in side view. One of the left and right support portions 94 (the right support portion 94) is provided with a contact portion 87 that receives a pressing force of a piston rod 77 of the second hydraulic cylinder 56 or the third hydraulic cylinder 57, which is described below, along the axial direction of the support shaft. A part between the left and right support portions 94 is a recessed portion 95 having the support portions 94 as side walls and the proximal end of the lock pawl portion 93 as a bottom surface.

The lock spring 83 is placed in the recessed portion 95 between the left and right support portions 94. The lock spring 83 has extension portions 84 and 85 at two ends of a coiled portion thereof. Under a biasing force in a direction in which the extension portions 84 and 85 are separated from each other, the lock spring 83 exerts a force that presses the lock pawl portion 93 down. The lock spring 83 is provided with the back support shaft 91 or the front support shaft 92 located between the left and right support portions 94 passing through the coiled portion.

The contact portion 87 is a portion that receives an external force that rotates the back locking member 48 or the front locking member 58 against the biasing force of the lock spring 83. The contact portion 87 protrudes from one of the left and right support portions 94 at an angle of approximately 90 degrees from a direction in which the lock pawl portion 93 extends.

The back locking member 48 has a hole portion through which the back support shaft 91 passes, in each of the support portions 94. The each of the support portions 94 is fixed to the back support shaft 91 by, for example, welding, and the back locking member 48 is configured as an integral solid of rotation that rotates relative to the back support shaft 91.

Figure 13:
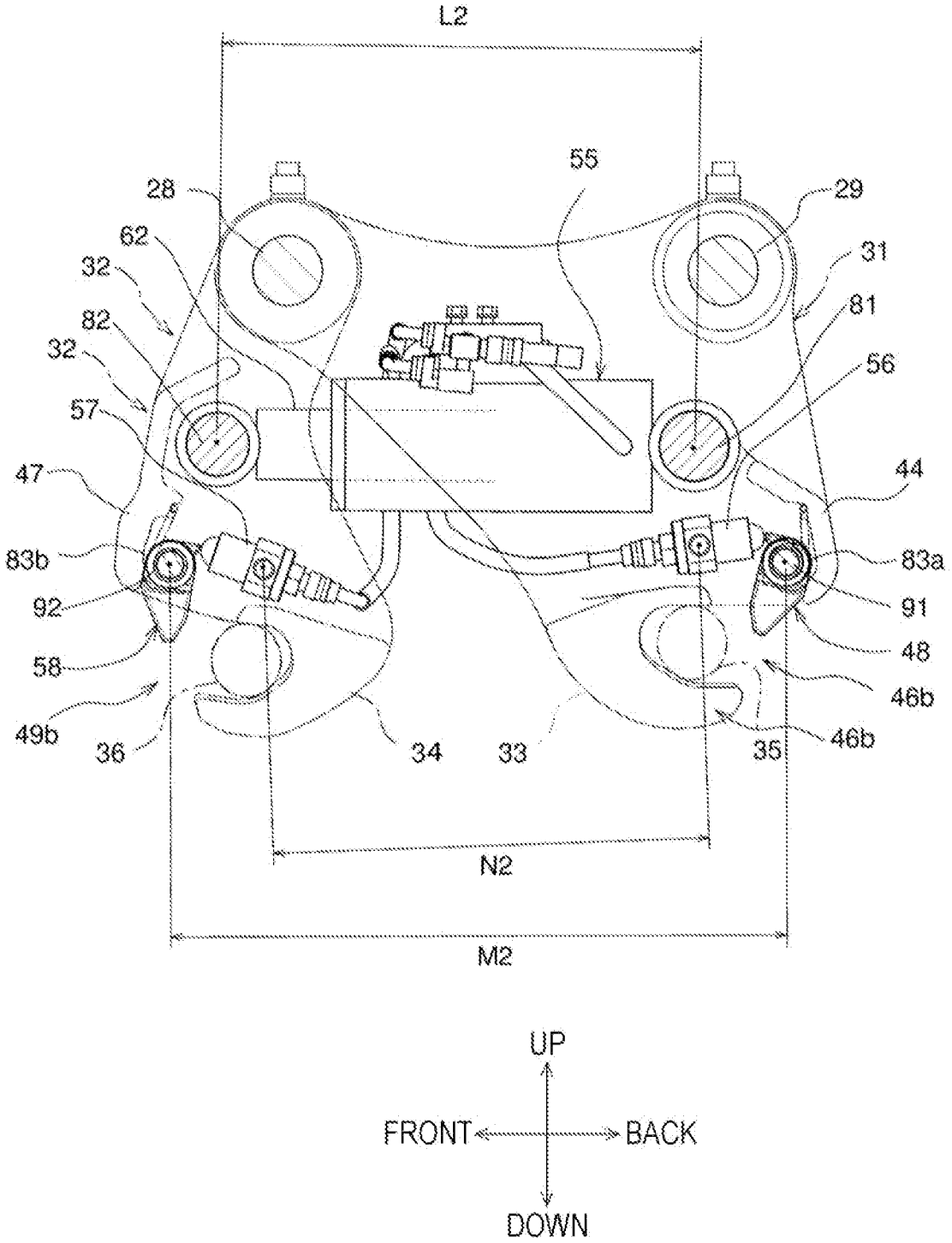
FIG. 13 is an operation explanatory diagram of the attachment mounting and demounting apparatus according to an embodiment of the present disclosure.

In terms of the rotating action of the back locking member 48 about the back support shaft 91, a rotated position where the lock pawl portion 93 has been caused to protrude from the lower side of the side wall frame portion 41 toward the opening portion 46*b* of the first hook 33 in side view is assumed to be a locked position that restricts the detachment of the back support pin 35 engaged with the first hook 33 from the first hook 33 (refer to FIG. 13). In other words, as illustrated in, for example, the drawing, the back locking member 48 performs the rotating action within a range from an unlocked position, which is hidden in an area of the outer shape of the fixed frame 31 in side view, to the locked position. The back locking member 48 rotates counterclockwise (counterclockwise) in the left side view illustrated in FIG. 13, thereby shifting from the unlocked position to the locked position.

The lock spring 83*a* is placed in the recessed portion 95 between the left and right support portions 94 of the back locking member 48. The lock spring 83*a* is a biasing member that biases the back locking member 48 in a direction of rotation toward the position (locked position) that restricts the detachment of the back support pin 35 from the first hook 33. In other words, in terms with the rotating action of the back locking member 48 about the back support shaft 91, the lock spring 83*a* biases the back locking member 48 in the direction of rotation from the unlocked position to the locked position. To put it another way, the lock spring 83*a* biases the back locking member 48 in the counterclockwise direction of rotation in the left side view.

The lock spring 83*a* causes the one extension portion 84 located outward of the coiled portion in the left-and-right direction to be caught on the back wall portion 44 of the fixed frame 31, and causes the other extension portion 85 located inward of the coiled portion in the left-and-right direction to be caught on the lock pawl portion 93. In other words, the back locking member 48 is biased by the lock spring 83*a* in the direction of rotation about the axis of the back support shaft 91 relative to the first hook 33 from the unlocked position to the locked position.

When the contact portion 87 of the back locking member 48 rotates under the pressing force of the piston rod 77 of the second hydraulic cylinder 56, the back locking member 48 rotates in a direction opposite to the direction toward the locked position.

The second hydraulic cylinder 56 is provided to the fixed frame 31, and performs the extension and contraction actions to rotate the back locking member 48 about the axis of the back support shaft 91 via the contact portion 87.

The front locking member 58 is provided in such a manner as to be rotatable integrally with the front support shaft 92. As in the back locking member 48, the front locking member 58 includes the lock pawl portion 93 that is the portion having the predetermined dimension in the left-and-right direction, and the left and right support portions 94 that are the portions supported by the front support shaft 92, and is provided with the recessed portion 95 in which the lock spring 83*b* is placed, between the left and right support portions 94. Moreover, one of the left and right support portions 94 (the left support portion 94) is provided with the contact portion 87 that receives a pressing force of the piston rod 77 of the third hydraulic cylinder 57 described below, along the axial direction of the front support shaft 92.

The lock spring 83*b* causes the one extension portion 84 located outward of the coiled portion in the left-and-right direction to be caught on the front wall portion 47 of the movable frame 32, and causes the other extension portion 85 located inward of the coiled portion in the left-and-right direction to be caught on the lock pawl portion 93. In other words, the front locking member 58 is biased by the lock spring 83*b* in a direction of rotation about the axis of the front support shaft 92 relative to the second hook 34 from the unlocked position to the locked position. To put it another way, the lock spring 83*b* biases the front locking member 58 in the clockwise direction of rotation in the left side view.

In terms of the rotating action of the front locking member 58 about the front support shaft 92, a rotated position where the lock pawl portion 93 has been caused to protrude from the lower side of the mounting frame portion 45 toward the opening portion 49*b* of the second hook 34 in side view is assumed to be a locked position that restricts the detachment of the front support pin 36 engaged with the second hook 34 from the second hook 34 (refer to FIG. 13). In other words, as illustrated in, for example, FIGS. 12 and 13, the front locking member 58 performs the rotating action within the range from the unlocked position, which is hidden in the area of the outer shape of the movable frame 32 in side view, to the locked position. The front locking member 58 rotates counterclockwise (counterclockwise) in the left side view, thereby shifting from the unlocked position to the locked position.

The third hydraulic cylinder 57 is provided to the movable frame 32, and performs the extension and contraction actions to rotate the front locking member 58 about the axis of the front support shaft 92 via the contact portion 87.

Figure 12:
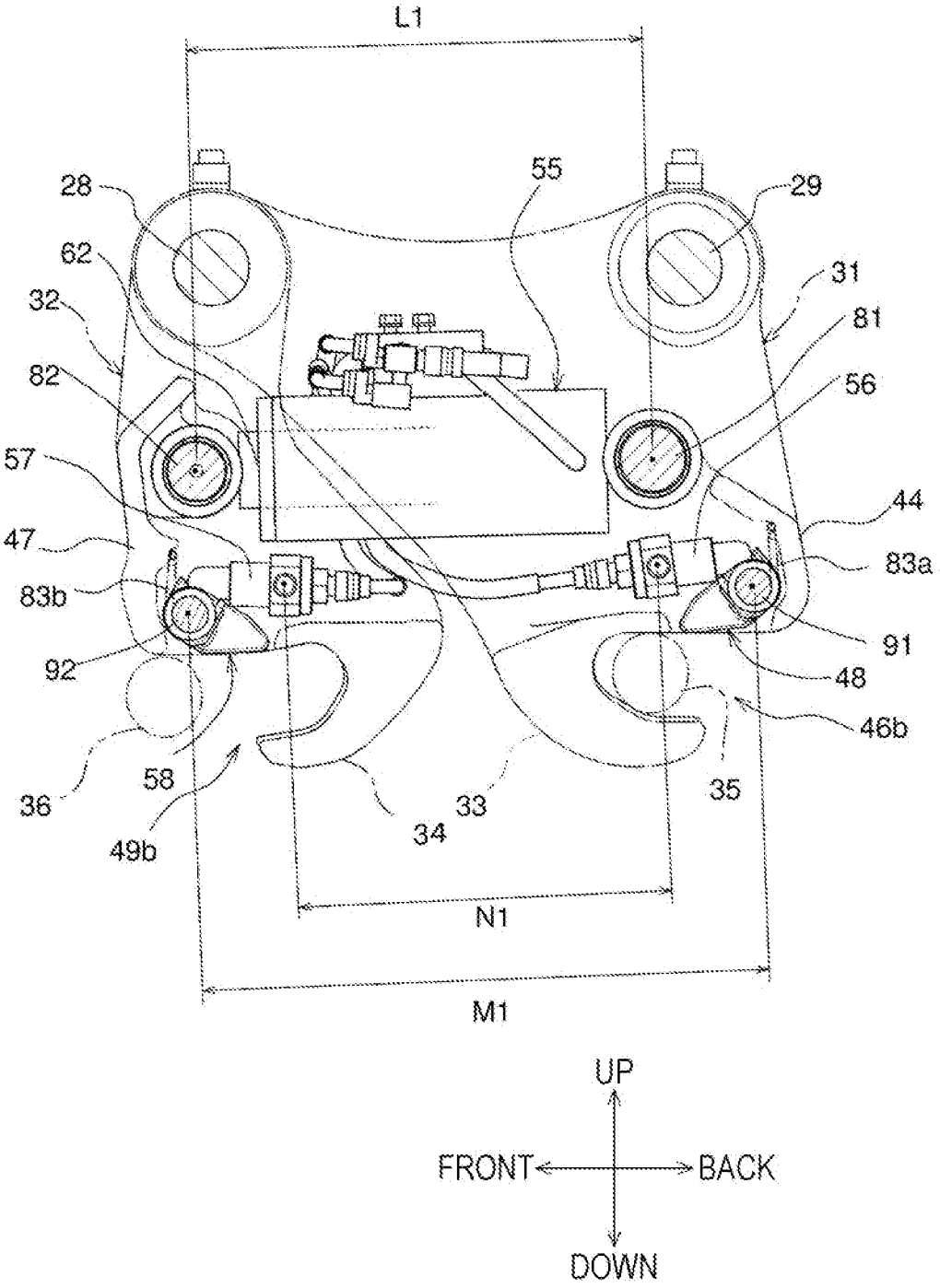
FIG. 12 is an operation explanatory diagram of the attachment mounting and demounting apparatus according to an embodiment of the present disclosure.

As illustrated in, for example, FIGS. 7 and 12, the second hydraulic cylinder 56 and the third hydraulic cylinder 57 are hydraulic cylinders smaller than the first hydraulic cylinder 55, and are provided in an orientation in which the extension/contraction direction is the front-and-back direction in plan view. Each of the second hydraulic cylinder 56 and the third hydraulic cylinder 57 includes a cylinder tube 76 and a piston rod 77 provided in such a manner as to be slidable relative to the cylinder tube 76, and extends and contracts on the basis of the sliding action of the piston rod 77 relative to the cylinder tube 76. The piston rod 77 is connected at one end to a piston 78 that slides in the cylinder tube 76, and the other end of the piston rod 77 serves as a contact end 77*a* that comes into contact with the contact portion 87 of each of the back locking member 48 and the front locking member 58.

Figure 9:
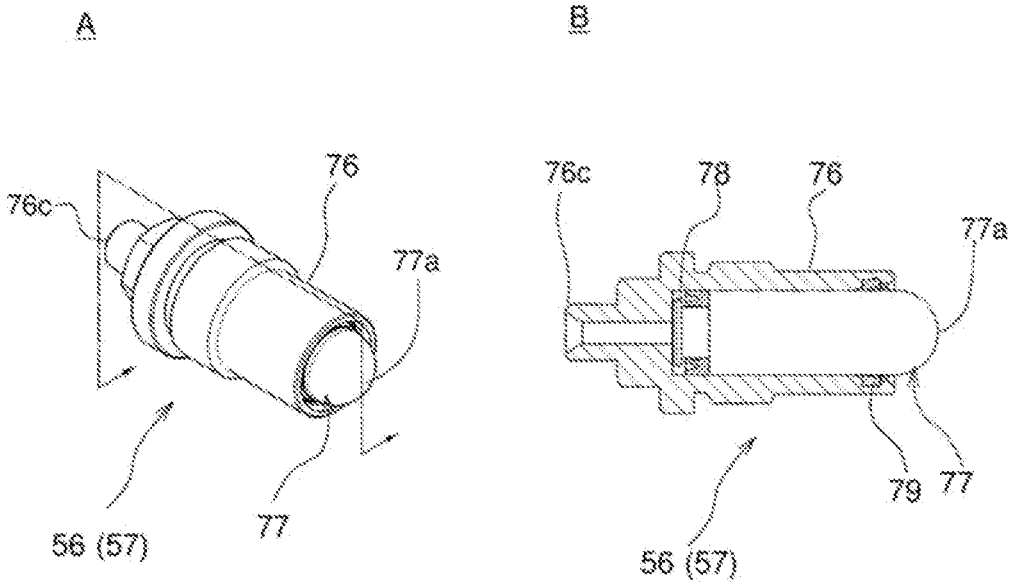
FIGS. 9A and 9B are explanatory diagrams of a second hydraulic cylinder and a third hydraulic cylinder of the attachment mounting and demounting apparatus according to an embodiment of the present disclosure.
Figure 10:
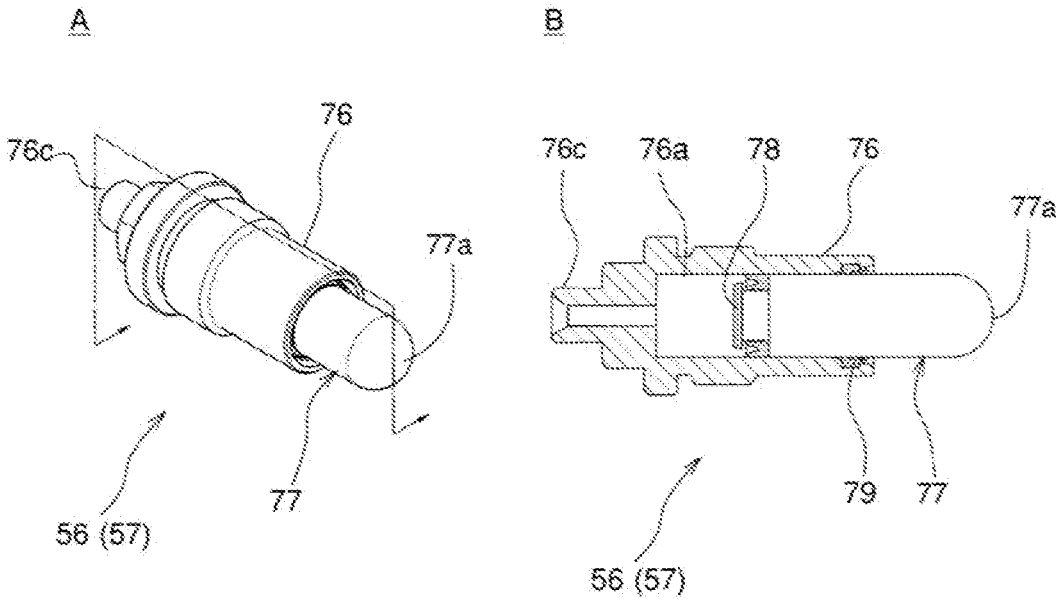
FIGS. 10A and 10B are explanatory diagrams of the second hydraulic cylinder and the third hydraulic cylinder of the attachment mounting and demounting apparatus according to an embodiment of the present disclosure.

As illustrated in FIG. 11, a bottom-side chamber 76*a*, which is a space on the bottom side of the cylinder tube 76, is formed by the piston 78 in the internal space of the cylinder tube 76. As illustrated in FIGS. 9 and 10, an end on the rod side of the cylinder tube 76 is open to movably store the piston rod 77 in the cylinder tube 76 and to allow an end of the piston rod 77 that is opposite to the end connected to the piston 78 to protrude from the cylinder tube 76. The end of the piston rod 77 that protrudes from the cylinder tube 76 has a hemispherical shape and serves as the contact end 77*a* that comes into contact with the contact portion 87 of each of the back locking member 48 and the front locking member 58. The piston rod 77 moves between the contracted state illustrated in the perspective view of FIG. 9A and the cross-sectional view of FIG. 9B and the extended state illustrated in the perspective view of FIG. 10A and the cross-sectional view of FIG. 10B on the basis of supply and discharge of the pressure oil to and from the bottom-side chamber 76*a*. When the piston rod 77 is in the contracted state, the hemispherical contact end 77*a* protrudes outward from the rod-side end of the cylinder tube 76. Therefore, for example, when the bucket 20 is operated to perform excavation work, it is possible to prevent ingress of, for example, earth and sand into between the inner side of the cylinder tube 76 and the sliding surface of the piston rod 77. Moreover, in the embodiment, the cylinder tube 76 is provided at the rod-side end with a sealing member 79 to further prevent ingress of foreign matter such as earth and sand into the cylinder tube 76.

The second hydraulic cylinder 56 and the third hydraulic cylinder 57 are connected to one ends of branch pipes 80*a* and 80*b* that branch from a rod-side hydraulic pipe 66 in such a manner that the branch pipes 80*a* and 80*b* communicate with the bottom-side chambers 76*a*. A connection port 76*c* connected to the branch pipe 80*a* protrudes from the cylinder tube 76. The branch pipes 80*a* and 80*b* are formed by hoses or the like. The other end of a branch pipe 80 communicates with and is connected to the rod-side hydraulic pipe 66.

The branch block 61*c* causes the rod-side hydraulic pipe 66 to branch into the branch pipes 80*a* and 80*b*. The branch block 61*c* is a member that is placed on the upper side of the cylinder tube 61 of the first hydraulic cylinder 55 together with a check valve 65*a* illustrated in FIG. 11, and connected to a bottom-side hydraulic pipe 65 and the rod-side hydraulic pipe 66. The branch block 61*c* is connected to the branch pipes 80*a* and 80*b* that supply the pressure oil to the second hydraulic cylinder 56 and the third hydraulic cylinder 57. The branch block 61*c* causes the pressure oil flowing through the rod-side hydraulic pipe 66 to branch into the branch pipes 80*a* and 80*b*. In other words, the branch block 61*c* causes the pressure oil to branch into a path in which pressure oil for causing the piston rod 62 of the first hydraulic cylinder 55 to contract is supplied to one of the cylinder chambers (the rod-side chamber 61*b*) of the cylinder tube 61 and, simultaneously, pressure oil for causing the piston rods 77 of the second hydraulic cylinder 56 and the third hydraulic cylinder 57 to extend is supplied to the second hydraulic cylinder 56 and the third hydraulic cylinder 57, and a path in which pressure oil for causing the piston rod 62 of the first hydraulic cylinder 55 to extend is supplied to the other cylinder chamber (the bottom-side chamber 61*a*) of the cylinder tube 61.

Moreover, when the hydraulic pressure that is supplied to the bottom-side chambers 76*a* through the branch pipe 80 exceeds a predetermined value, the second hydraulic cylinder 56 and the third hydraulic cylinder 57 cause the piston rods 77 to protrude further from the cylinder tubes 76 to extend the piston rods 77 further. On the other hand, in terms of the return, the piston rods 77 may be of a load return type or a spring return type. For example, in the case of the load return type, when the hydraulic pressure in the bottom-side chambers 76*a* decreases to or below the predetermined value, the back locking member 48 and the front locking member 58 are rotated by the biasing force of the lock springs 83, and the contact portions 87 are rotated to move the piston rods 77 in the contraction direction with the external force pressing the contact ends 77*a* of the piston rods 77. Moreover, in the case of the spring return type, a coil spring is provided on the back of the piston 78 of each of the cylinder tubes 76, and when the hydraulic pressure in the bottom-side chambers 76*a* decreases to or below a predetermined value, the piston rods 77 are moved in the contraction direction via the pistons 78 by elastic forces of the coil springs.

A description is given of the positional relationship between the first hydraulic cylinder 55, the second hydraulic cylinder 56, and the third hydraulic cylinder 57 in the attachment mounting and demounting apparatus 30.

In the attachment mounting and demounting apparatus 30, the first hydraulic cylinder 55 is provided between the left and right side wall frame portions 41 and between the left and right mounting frame portions 45. In the embodiment, the first hydraulic cylinder 55 is placed in the middle between the left and right side wall frame portions 41 in the left-and-right direction.

In such a configuration, the second hydraulic cylinder 56 is placed below the first hydraulic cylinder 55 and closer to one of the left and right side wall frame portions 41 via a second hydraulic cylinder support shaft 98 as a fifth support shaft. The second hydraulic cylinder support shaft 98 is located between the bottom-side support shaft 81 that is the first support shaft and the back support shaft 91 that is the third support shaft in the up-and-down direction, and is provided parallel to the bottom-side support shaft 81 and the back support shaft 91. In the embodiment, the second hydraulic cylinder 56 is placed between the first hydraulic cylinder 55 and the left side wall frame portion 41 of the pair of left and right side wall frame portions 41 in the left-and-right direction.

Moreover, the third hydraulic cylinder 57 is placed below the first hydraulic cylinder 55 and closer to one of the left and right mounting frame portions 45 via a third hydraulic cylinder support shaft 99 as a sixth support shaft. The third hydraulic cylinder support shaft 99 is located between the rod-side support shaft 82 that is the second support shaft and the front support shaft 92 that is the fourth support shaft in the up-and-down direction, and is provided parallel to the rod-side support shaft 82 and the front support shaft 92. In the embodiment, the third hydraulic cylinder 57 is placed between the first hydraulic cylinder 55 and the left mounting frame portion 45 of the pair of left and right mounting frame portions 45 in the left-and-right direction.

The hydraulic circuit that operates the first hydraulic cylinder 55, the second hydraulic cylinder 56, and the third hydraulic cylinder 57 is further described.

As illustrated in FIG. 11, one end of the bottom-side hydraulic pipe 65 formed by, for example, a hose is connected to the first hydraulic cylinder 55 in such a manner as to communicate with the bottom-side chamber 61*a*. The other end of the bottom-side hydraulic pipe 65 is connected to a bottom-side cylinder port (A) of a solenoid switch valve 67 for switching the flow path. The bottom-side hydraulic pipe 65 is provided with the check valve 65*a*.

Moreover, one end of the rod-side hydraulic pipe 66 formed by, for example, a hose is connected to the first hydraulic cylinder 55 in such a manner as to communicate with the rod-side chamber 61*b*. The other end of the rod-side hydraulic pipe 66 is connected to a rod-side cylinder port (B) of the solenoid switch valve 67.

A supply port (P) of the solenoid switch valve 67 is connected to one end of a supply pipe 68. The other end of the supply pipe 68 is open, facing an oil tank 69 provided in the travel device 2. The supply pipe 68 is provided with a hydraulic pump 64, and the hydraulic fluid in the oil tank 69 is supplied by the operation of the hydraulic pump 64 to the first hydraulic cylinder 55 through the solenoid switch valve 67. Moreover, an exhaust port (T) of the solenoid switch valve 67 is connected to one end of an exhaust pipe 70 that is a return pipe to the oil tank 69. The other end of the exhaust pipe 70 is open, facing the oil tank 69. Moreover, a relief valve 71 that controls the pressure of the hydraulic fluid sent out from the hydraulic pump 64 is interposed between the supply pipe 68 and the exhaust pipe 70.

The operations of mounting and demounting the bucket 20 by the attachment mounting and demounting apparatus 30 are described with reference to FIGS. 12 and 13. Note that, in these drawings, an illustration of a part of the configuration of the attachment mounting and demounting apparatus 30 is omitted for convenience. Moreover, in these drawings, the external shape of the attachment mounting and demounting apparatus 30 is indicated by alternate long and short dashed lines, and the back support pin 35 and the front support pin 36 of the bucket 20 are indicated by chain double-dashed line.

In the following description, a state in which the bucket 20 is coupled and supported in the excavation device 3 and in which the attachment mounting and demounting apparatus 30 is engaged with the bucket 20 is referred to as the "engaged state." In the attachment mounting and demounting apparatus 30 in the engaged state, the first hydraulic cylinder 55 has been extended, and the second hook 34 of the movable frame 32 is farthest from the first hook 33 of the fixed frame 31. At this point in time, as illustrated in FIG. 13, a shaft center-to-shaft center distance L1 between the bottom-side support shaft 81 and the rod-side support shaft 82 is less than a shaft center-to-shaft center distance M1 between the back support shaft 91 and the front support shaft 92. Moreover, a shaft center-to-shaft center distance N1 between the second hydraulic cylinder support shaft 98 and the third hydraulic cylinder support shaft 99 is less than the shaft center-to-shaft center distance M1 between the back support shaft 91 and the front support shaft 92.

Moreover, a state before the bucket 20 is mounted on or after the bucket 20 is removed from, the excavation device 3, in which the attachment mounting and demounting apparatus 30 has been disengaged from the bucket 20, is referred to as the "disengaged state." In the attachment mounting and demounting apparatus 30 in the disengaged state, the first hydraulic cylinder 55 has been contracted, and the second hook 34 of the movable frame 32 is closest to the first hook 33 of the fixed frame 31. At this point in time, as illustrated in FIG. 12, a shaft center-to-shaft center distance L2 between the bottom-side support shaft 81 and the rod-side support shaft 82 is less than a shaft center-to-shaft center distance M2 between the back support shaft 91 and the front support shaft 92. Moreover, a shaft center-to-shaft center distance N2 between the second hydraulic cylinder support shaft 98 and the third hydraulic cylinder support shaft 99 is less than the shaft center-to-shaft center distance M1 between the back support shaft 91 and the front support shaft 92.

In other words, the attachment mounting and demounting apparatus 30 regards, as the engaged state, the state in which the first hook 33 and the second hook 34 have been engaged with the back support pin 35 and the front support pin 36 of the bucket 20, respectively, and regards, as the disengaged state, the state in which the first hook 33 and the second hook 34 have been disengaged from their respective support pins (a not-engaged state). In both of the engaged state and the disengaged state, a magnitude relationship of the shaft center-to-shaft center distance between the back support shaft 91 and the front support shaft 92>the shaft center-to-shaft center distance between the bottom-side support shaft 81 and the rod-side support shaft 82>the shaft center-to-shaft center distance between the second hydraulic cylinder support shaft 98 and the third hydraulic cylinder support shaft 99 is established in the front-and-back direction of the attachment mounting and demounting apparatus 30. Note that the magnitude of the shaft center-to-shaft center distance between the second hydraulic cylinder support shaft 98 and the third hydraulic cylinder support shaft 99 as compared to the shaft center-to-shaft center distance between the back support shaft 91 and the front support shaft 92 may be changed, according to the size of the first hydraulic cylinder 55 and/or where in the second hydraulic cylinder 56 and the third hydraulic cylinder 57 the support shafts (98 and 99) are provided.

The bucket 20 is placed on, for example, the ground with the side where the front support pin 36 and the back support pin 35 facing upward. The boom 17 and the arm 18 of the excavation device 3 are operated by operating, for example, the operating unit provided in the cabin 10 to move the attachment mounting and demounting apparatus 30. As a result, the attachment mounting and demounting apparatus 30 performs the mounting and demounting work for the bucket 20.

In other words, when the bucket 20 is attached to the attachment mounting and demounting apparatus 30, the operating unit and the like that are provided in the cabin 10 are operated to bring the attachment mounting and demounting apparatus 30 in the disengaged state closer to the bucket 20 placed on, for example, the ground. The attachment mounting and demounting apparatus 30 is brought into the engaged state while being caused to be engaged with the bucket 20 in a predetermined procedure. The bucket 20 is thereby attached to the attachment mounting and demounting apparatus 30.

On the other hand, when the bucket 20 is removed from the attachment mounting and demounting apparatus 30, the operating unit and the like that are provided in the cabin 10 are operated to place the bucket 20 on, for example, the ground. The attachment mounting and demounting apparatus 30 is brought into the disengaged state while being caused to be disengaged from the bucket 20 in a predetermined procedure. The attachment mounting and demounting apparatus 30 is then separated from the bucket 20 in response to the operations on the operating unit and the like that are provided in the cabin 10. The bucket 20 is thereby removed from the attachment mounting and demounting apparatus 30.

The operation of the attachment mounting and demounting apparatus 30 for attaching the bucket 20 to the attachment mounting and demounting apparatus 30 (for bucket mounting) is described. Note that when the hydraulic pressure is not supplied to the attachment mounting and demounting apparatus 30 in the disengaged state thereof, the first hydraulic cylinder 55, the second hydraulic cylinder 56, and the third hydraulic cylinder 57 are in the contracted state. In other words, the back locking member 48 of the first hook 33 and the front locking member 58 of the second hook 34 are in the locked positions that have been reached by biasing the lock springs 83 in such a manner that the distal ends of the lock pawl portions 93 face downward.

When the bucket 20 is mounted, the attachment mounting and demounting apparatus 30 in the disengaged state is brought closer to the bucket 20 in response to an operation on, for example, the operating unit provided in the cabin 10 (refer to FIGS. 3 and 13). In the attachment mounting and demounting apparatus 30 in the disengaged state, the distance between the distal ends of the latch portions 46 and 49 of the first hook 33 and the second hook 34 is less than the distance between the back support pin 35 and the front support pin 36 of the bucket 20.

Next, the hydraulic circuit of the attachment mounting and demounting apparatus 30 is operated in response to an operation command of the operating unit in the cabin 10. The back locking member 48 and the front locking member 58 are moved to the unlocked positions to enable and the first hook 33 and the second hook 34 to receive the back support pin 35 and the front support pin 36. At this point in time, in the hydraulic circuit, the solenoid switch valve 67 is in a state in which the supply port (P) communicates with the rod-side cylinder port (B) and the exhaust port (T) communicates with the bottom-side cylinder port (A) as a flow path switching state. Therefore, the operation of the hydraulic pump 64 allows the pressure oil to be supplied from the supply pipe 68, through the solenoid switch valve 67, to the rod-side hydraulic pipe 66 and to the rod-side chamber 61*b* of the first hydraulic cylinder 55, and allows the pressure oil to be supplied to the bottom-side chambers 76*a* of the second hydraulic cylinder 56 and the third hydraulic cylinder 57 through the branch pipes 80, 80*a*, and 80*b* branched from the rod-side hydraulic pipe 66.

In other words, in the first hydraulic cylinder 55, the contracted state of the piston rod 62 is maintained, whereas in the second hydraulic cylinder 56 and the third hydraulic cylinder 57, the pressure oil is supplied to the bottom-side chambers 76*a* to extend the piston rods 77. Consequently, the pressing force is applied to the contact portion 87 of the back locking member 48. The contact portion 87 and the lock pawl portion 93 rotate together with the back support shaft 91, and the lock pawl portion 93 is stored above the first hook 33. Similarly, the pressing force is applied to the contact portion 87 of the front locking member 58. The contact portion 87 and the lock pawl portion 93 rotate together with the front support shaft 92. The lock pawl portion 93 is stored above the second hook 34. In other words, the back locking member 48 and the front locking member 58 move to the unlocked positions.

The back locking member 48 and the front locking member 58 have been moved to the unlocked positions, which enables the latch portion 46 of the first hook 33 to receive the back support pin 35, and enables the latch portion 49 of the second hook 34 to receive the front support pin 36.

After the back locking member 48 and the front locking member 58 have been moved to the unlocked positions, the back support pin 35 is engaged with the first hook 33 first. Next, the action of extending the first hydraulic cylinder 55 is performed with the back support pin 35 engaged with the first hook 33. In other words, the operation of the hydraulic pump 64 allows the pressure oil to be supplied from the supply pipe 68, through the solenoid switch valve 67, to the bottom-side hydraulic pipe 65 and to the bottom-side chamber 61*a*. The first hydraulic cylinder 55 extends as illustrated in FIG. 13. In the hydraulic circuit illustrated in FIG. 11, the solenoid switch valve 67 is in a state in which the supply port (P) communicates with the bottom-side cylinder port (A) and the exhaust port (T) communicates with the rod-side cylinder port (B) as the flow path switching state.

When the first hydraulic cylinder 55 extends, the movable frame 32 rotates forward about the link support shaft 28, and the latch portion 46 of the second hook 34 is caused to be engaged with the front support pin 36 (refer to FIG. 13). In terms of the direction of rotation of the movable frame 32, the direction in which the second hook 34 is engaged with the front support pin 36 is a clockwise direction in the left side view, and the direction in which the second hook 34 is disengaged from the front support pin 36 is a counterclockwise direction in the left side view.

Moreover, during the extension action of the first hydraulic cylinder 55, the hydraulic fluid is discharged from the rod-side chamber 61*b* into the rod-side hydraulic pipe 66 in step with the movement of the piston 63. Thereafter, the hydraulic fluid in the bottom-side chambers 76*a* of the second hydraulic cylinder 56 and the third hydraulic cylinder 57 is also discharged from the branch pipes 80*a*, 80*b*, and 80 into the rod-side hydraulic pipe 66. The contraction actions of the second hydraulic cylinder 56 and the third hydraulic cylinder 57 are performed after the extension action of the first hydraulic cylinder 55 is performed. This is because the force that causes the second hydraulic cylinder 56 and the third hydraulic cylinder 57 to contract is sufficiently small as compared to the force of the hydraulic pump 64 that causes the first hydraulic cylinder 55 to extend, and therefore the discharge of the hydraulic fluid in the bottom-side chambers 76*a* of the second hydraulic cylinder 56 and the third hydraulic cylinder 57 occurs later than the discharge of the hydraulic fluid from the rod-side chamber 61*b* of the first hydraulic cylinder 55.

When further extension of the first hydraulic cylinder 55 has been restricted due to the engagement of the second hook 34 with the front support pin 36, pressure in the path from the hydraulic pump 64 to the bottom-side chamber 61*a* of the first hydraulic cylinder 55 is maintained at a predetermined value due to the operation of the relief valve 71. In other words, the force that separates the first hook 33 and the second hook 34 from each other, the force being generated due to the extension action of the first hydraulic cylinder 55, allows the back support pin 35 to be fastened to the engagement surface 46*a* of the first hook 33, and the front support pin 36 to be fastened to the engagement surface 49*a* of the second hook 34.

As illustrated in FIG. 13, when the first hook 33 has been engaged with the back support pin 35, the second hook 34 has been engaged with the front support pin 36, and the extension of the first hydraulic cylinder 55 has been stopped, the second hydraulic cylinder 56 and the third hydraulic cylinder 57 automatically draw the piston rods 77 into the cylinder tubes 76 and contract.

Since the second hydraulic cylinder 56 has contracted and the pressing force has stopped being applied to the contact portion 87, the biasing force of the lock spring 83*a* acts on the back locking member 48, and the back locking member 48 rotates together with the back support shaft 91. Consequently, the back locking member 48 moves (rotates) from the unlocked position to the locked position. Similarly, the third hydraulic cylinder 57 has contracted and the pressing force has stopped being applied to the contact portion 87, the biasing force of the lock spring 83*b* acts on the front locking member 58, and the front locking member 58 rotates together with the front support shaft 92. Consequently, the front locking member 58 moves (rotates) from the unlocked position to the locked position. In other words, the locked state in which the detachment of the back support pin 35 engaged with the first hook 33 from the first hook 33 is restricted by the back locking member 48, and the locked state in which the detachment of the front support pin 36 engaged with the second hook 34 from the second hook 34 is restricted by the front locking member 58 are obtained.

As described above, the attachment mounting and demounting apparatus 30 enters the engaged state, and the state in which the second hook 34 and the first hook 33 are engaged with the front and back support pins (35 and 36), respectively, and the locked state obtained by the front and back locking members (58 and 48) at the engaged portions of the hooks (33 and 34) with the support pins (35 and 36) are obtained as the mounted state of the bucket 20 on the attachment mounting and demounting apparatus 30.

The locked state obtained by the front and back locking members (58 and 48) is achieved by causing the front and back locking members (58 and 48) to protrude toward the opening portions (49*b* and 46*b*) of the second hook 34 and the first hook 33 by use of the biasing forces of the lock springs 83.

Next, the operation of the attachment mounting and demounting apparatus 30 for removing the bucket 20 from the attachment mounting and demounting apparatus 30 (for bucket removable) is described. The operation of the attachment mounting and demounting apparatus 30 for bucket removal is basically a procedure reversed from the operation for bucket mounting.

The operation of causing the second hydraulic cylinder 56 and the third hydraulic cylinder 57 to extend and simultaneously causing the first hydraulic cylinder 55 to contract is performed from the state in which the attachment mounting and demounting apparatus 30 is in the engaged state with the bucket 20 mounted thereon as illustrated in FIG. 13.

As illustrated in FIG. 11, the operation of the hydraulic pump 64 allows the pressure oil to be supplied from the supply pipe 68, through the solenoid switch valve 67, to the rod-side hydraulic pipe 66, to the branch pipe 80, and to the bottom-side chamber 76*a*. The second hydraulic cylinder 56 and the third hydraulic cylinder 57 extend. Moreover, the hydraulic pressure is supplied to the rod-side chamber 61*b* of the first hydraulic cylinder 55, and the first hydraulic cylinder 55 contracts. The solenoid switch valve 67 is in the state in which the supply port (P) communicates with the rod-side cylinder port (B) and the exhaust port (T) communicates with the bottom-side cylinder port (A) as the flow path switching state.

When the second hydraulic cylinder 56 extends, the pressing force is applied from the piston rod 77 to the contact portion 87, and the back locking member 48 rotates together with the back support shaft 91 against the biasing force of the lock spring 83*a*. Consequently, the back locking member 48 moves (rotates) from the locked position to the unlocked position. Similarly, when the third hydraulic cylinder 57 extends, the pressing force is applied from the piston rod 77 to the contact portion 87, and the front locking member 58 rotates together with the front support shaft 92 against the biasing force of the lock spring 83*a*. Consequently, the front locking member 58 moves (rotates) from the locked position to the unlocked position. In other words, the unlocked state in which the back support pin 35 engaged with the first hook 33 can be detached from the first hook 33, and the unlocked state in which the front support pin 36 engaged with the second hook 34 can be detached from the second hook 34 can be obtained by the back locking member 48 and the front locking member 58.

According to the hydraulic circuit configuration (refer to FIG. 11) included in the excavation work machine 1, the contraction action of the first hydraulic cylinder 55 and the extension action of the second hydraulic cylinder 56 and the third hydraulic cylinder 57 are simultaneously executed in response to a command of the operating unit in the cabin 10 to switch the flow path of the solenoid switch valve 67.

However, there is a time difference between the start timings of these two actions. The second hydraulic cylinder 56 and the third hydraulic cylinder 57 are hydraulic cylinders that are sufficiently smaller than the first hydraulic cylinder 55. Therefore, when the pressure oil is supplied from the rod-side hydraulic pipe 66 to the rod-side chamber 61*b* of the first hydraulic cylinder 55, the pressure oil supplied to the second hydraulic cylinder 56 and the third hydraulic cylinder 57 through the branch pipes 80, 80*a*, and 80*b* branched from the rod-side hydraulic pipe 66 causes the second hydraulic cylinder 56 and the third hydraulic cylinder 57 to perform the extension action prior to the contraction action of the first hydraulic cylinder 55.

When the first hydraulic cylinder 55 contracts, the movable frame 32 rotates backward about the link support shaft 28, and the latch portion 46 of the second hook 34 is disengaged from the front support pin 36.

As described above, the attachment mounting and demounting apparatus 30 enters the disengaged state. The boom 17 and/or the arm 18 of the excavation device 3 is operated in response to an operation command of the operating unit in the cabin 10 to move the attachment mounting and demounting apparatus 30; therefore, the first hook 33 is disengaged from the back support pin 35. Consequently, the bucket 20 is removed from the attachment mounting and demounting apparatus 30.

Figure 14:
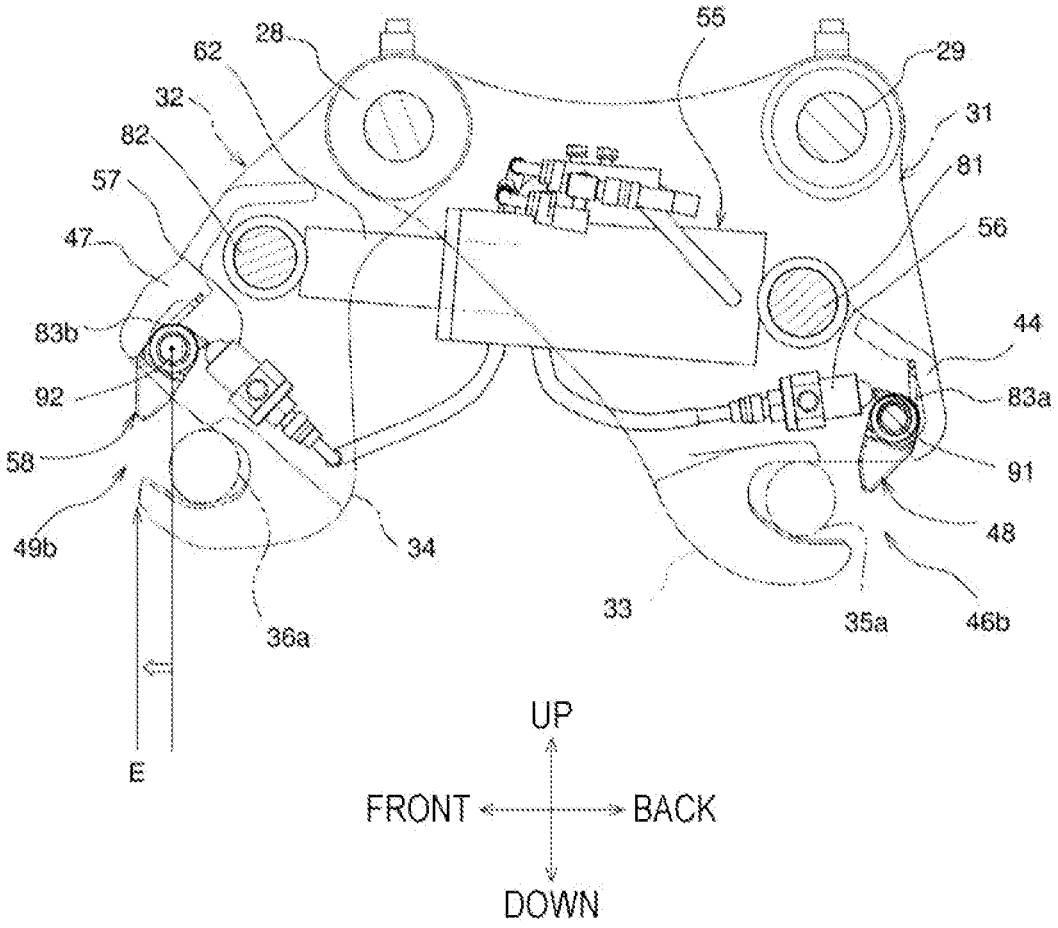
FIG. 14 is an operation explanatory diagram of the attachment mounting and demounting apparatus according to an embodiment of the present disclosure.

FIG. 14 illustrates a state in which an attachment including a back support pin 35*a* and a front support pin 36*a* is mounted, a distance between which is greater than the distance between the back support pin 35 and the front support pin 36 of the bucket 20.

The attachment mounting and demounting apparatus 30 can change the distance between the first hook 33 and the second hook 34 within a range from a state in which the piston rod 62 of the first hydraulic cylinder 55 has been caused to contract minimally to a state in which the piston rod 62 has been caused to extend maximally. In the state in which the first hydraulic cylinder 55 has been caused to extend maximally, a distal end E of the second hook 34 is forward of the position (the position of the shaft center) of the front support shaft 92 in the extension/contraction direction of the first hydraulic cylinder 55. The third hydraulic cylinder 57 provided to the movable frame 32 is connected by a flexible pipe to the branch block 61*c* on the cylinder tube 61 of the first hydraulic cylinder 55. Such a pipe deforms flexibly when the movable frame 32 rotates in step with the extension of the first hydraulic cylinder 55; therefore, the extension of the first hydraulic cylinder 55 is not restricted. Therefore, the movable frame 32 can be rotated relative to the fixed frame 31 up to a position where the distal end E of the second hook 34 is forward of the front support shaft 92 in the extension/contraction direction of the first hydraulic cylinder 55. In this manner, the angle of rotation of the movable frame 32 relative to the fixed frame 31 can be increased as compared to before; therefore, the distance apart between the first hook 33 and the second hook 34 can also be increased as compared to before. In the attachment mounting and demounting apparatus 30, it is possible to couple more attachments that vary in distance between the support pins.

In the above attachment mounting and demounting apparatus 30 and excavation work machine 1 equipped with the same according to the embodiment, the back locking member 48 and the front locking member 58 that do not require hydraulic pressure to maintain the locked states of the support pins can prevent the support pins from coming out of the first hook 33 and the second hook 34 even when the supply of hydraulic pressure to the first hydraulic cylinder 55 is cut off with the bucket 20 coupled to the attachment mounting and demounting apparatus 30. Therefore, the coupled state of the bucket 20 can be maintained, and a high level of safety can be achieved The attachment mounting and demounting apparatus 30 of the embodiment supports the support pins (35 and 36) of the attachment by extending the first hydraulic cylinder 55, and holds the back locking member 48 and the front locking member 58 in the locked positions by use of the biasing forces of the lock springs 83 provided respectively to the back locking member 48 and the front locking member 58. The back locking member 48 is moved from the locked position to the unlocked position by the operation of the second hydraulic cylinder 56, and the front locking member 58 is moved from the locked position to the unlocked position by the operation of the third hydraulic cylinder 57. The operations of the second hydraulic cylinder 56 and the third hydraulic cylinder 57 at this point in time are linked to the operation of the first hydraulic cylinder 55.

According to such a configuration, excellent workability can be obtained in the operations of mounting and demounting the bucket 20 on and from the attachment mounting and demounting apparatus 30 and, even when power supply to the second hydraulic cylinder 56 is cut off due to, for example, breakage of a hydraulic device or the like, the locked state of the first hook 33 on the back support pin 35 by the back locking member 48, and the locked state of the second hook 34 on the front support pin 36 by the front locking member 58 are secured by the biasing forces of the lock springs 83. Consequently, safety can be ensured.

Moreover, in the attachment mounting and demounting apparatus 30, the configuration for holding the back locking member 48 in the locked position and the configuration for holding the front locking member 58 in the locked position include the members having the same functions and shapes, and are placed in such a manner as to be mirror symmetrical in the front-and-back direction in the left side view of the attachment mounting and demounting apparatus 30. According to such a configuration, it is possible to achieve commonality of the retaining members of the support pins (35 and 36) of the bucket 20 between the first hook 33 and the second hook 34; therefore, the assembly efficiency of the attachment mounting and demounting apparatus 30 improves. Moreover, it is possible to easily realize the double-lock structure, to effectively prevent disengagement of the bucket 20 from the attachment mounting and demounting apparatus 30, and to improve safety.

Moreover, in the attachment mounting and demounting apparatus 30, the second hydraulic cylinder 56 is placed between the left and right side wall frame portions 41 of the fixed frame 31, specifically between the first hydraulic cylinder 55 and the right side wall frame portion 41, and the third hydraulic cylinder 57 is placed between the left and right mounting frame portions 45 of the movable frame 32, specifically between the first hydraulic cylinder 55 and the right mounting frame portion 45.

According to such a configuration, the space between the first hydraulic cylinder 55 and the side wall frame portion 41 can be used as the working space of the second hydraulic cylinder 56, and the space between the first hydraulic cylinder 55 and the movable frame 32 can be used as the working space of the third hydraulic cylinder 57. Therefore, it is possible to design the compact attachment mounting and demounting apparatus 30.

The description of the above-mentioned embodiment is an example of the present disclosure, and the attachment mounting and demounting apparatus and the construction machine according to the present disclosure are not limited to the above-mentioned embodiment. Therefore, naturally, various modifications can be made, according to, for example, the design, without departing from the technical idea according to the present disclosure even in an embodiment other than the above-mentioned embodiment.

For example, in the above-mentioned embodiment, the second hydraulic cylinder 56 is placed on the right side wall frame portion 41 of the left and right side wall frame portions 41 via the second hydraulic cylinder support shaft 98, and the third hydraulic cylinder 57 is placed on the right mounting frame portion 45 of the left and right mounting frame portions 45 via the third hydraulic cylinder support shaft 99. However, the second hydraulic cylinder 56 and the third hydraulic cylinder 57 may be placed on the left side wall frame portion 41 and the left mounting frame portion 45, respectively.

Moreover, in the above-mentioned embodiment, the hydraulic circuit configuration (refer to FIG. 11) for operating the first hydraulic cylinder 55 and the second hydraulic cylinder 56 is a mere example. In other words, as long as the above-mentioned operations of the hydraulic cylinders including the first hydraulic cylinder 55, the second hydraulic cylinder 56, and the third hydraulic cylinder 57 at the time of bucket mounting and bucket removal can be obtained, the hydraulic circuit configuration for operating these hydraulic cylinders is not particularly limited.

Note that the present disclosure can take the following aspects:

(1)

A construction machine attachment mounting and demounting apparatus that mounts and demounts an attachment for work on and from an arm of a working device, the attachment mounting and demounting apparatus being including:

a first member that has a first hook and is coupled to the arm;

a second member that has a second hook and is rotatably supported by the first member;

a first hydraulic cylinder that has one end coupled to a first support shaft provided to the first member, and the other end coupled to a second support shaft provided to the second member, and rotates the second member relative to the first member;

a first retaining member that is rotatably supported by a third support shaft provided to the first member, the third support shaft being placed above the first hook, and is biased by a first biasing member in such a manner as to protrude from an opening portion of the first hook;

a second hydraulic cylinder that moves the first retaining member against the biasing force of the first biasing member in such a manner as to retract the first retaining member from the opening portion of the first hook in conjunction with the operation of the first hydraulic cylinder;

a second retaining member that is rotatably supported by a fourth support shaft provided to the second member, the fourth support shaft being placed above the second hook, and is biased by a second biasing member in such a manner as to protrude from an opening portion of the second hook; and a third hydraulic cylinder that moves the second retaining member against the second biasing member in such a manner as to retract the second retaining member from the opening portion of the second hook in conjunction with the operation of the first hydraulic cylinder.

(2)

The construction machine attachment mounting and demounting apparatus according to (1), in which the second hydraulic cylinder is placed between the first support shaft and the third support shaft, and the third hydraulic cylinder is placed between the second support shaft and the fourth support shaft.

(3)

The construction machine attachment mounting and demounting apparatus according to (1) or (2), in which a distance between shaft centers of the first support shaft and the second support shaft is less than a distance between shaft centers of the third support shaft and the fourth support shaft.

(4)

The construction machine attachment mounting and demounting apparatus according to (2), in which a distance between shaft centers of a fifth support shaft that supports the second hydraulic cylinder and a sixth support shaft that supports the third hydraulic cylinder is less than a distance between shaft centers of the third support shaft and the fourth support shaft.

(5)

The construction machine attachment mounting and demounting apparatus according to any of (1) to (4), in which upon a rod of the first hydraulic cylinder being maximally extended, a distal end of the second hook is forward of the fourth support shaft.

(6)

The construction machine attachment mounting and demounting apparatus according to any of (1) to (5), in which the first hydraulic cylinder is a double-acting hydraulic cylinder, the second hydraulic cylinder and the third hydraulic cylinder are single-acting hydraulic cylinders, and a branch block is provided in the first member to cause pressure oil to branch into a path in which pressure oil for causing the rod of the first hydraulic cylinder to contract is supplied to one of cylinder chambers of a cylinder tube and, simultaneously, pressure oil for causing rods of the second hydraulic cylinder and the third hydraulic cylinder to extend is supplied to the second hydraulic cylinder and the third hydraulic cylinder, and a path in which pressure oil for causing the rod of the first hydraulic cylinder to extend is supplied to the other cylinder chamber of the cylinder tube.

(7)

The construction machine attachment mounting and demounting apparatus according to (6), in which the branch block is placed above the cylinder tube of the first hydraulic cylinder.

(8)

The construction machine attachment mounting and demounting apparatus according to (6), in which an end of the rod of each of the second hydraulic cylinder and the third hydraulic cylinder has a hemispherical shape, and protrudes further than an end of a respective cylinder tube thereof during contraction of the second hydraulic cylinder and the third hydraulic cylinder.

(9)

A construction machine including:

the construction machine attachment mounting and demounting apparatus according to any of (1) to (8);

a travel device; and a front working device that is provided on a front side of the travel device and has the arm that causes the attachment mounting and demounting apparatus to detachably support the attachment.

LIST OF REFERENCE SIGNS

1 Excavation work machine (construction machine)
2 Travel device
3 Excavation device (front working device)
18 Arm
20 Bucket (attachment)
30 Attachment mounting and demounting apparatus
31 Fixed frame (first member)
32 Movable frame (second member)
33 First hook
34 Second hook
35 Front support pin
36 Back support pin
41 Side wall frame portion (wall portion)
44 Back wall portion
45 Mounting frame portion (wall portion)
47 Front wall portion
48 Back locking member (first retaining member)
55 First hydraulic cylinder
56 Second hydraulic cylinder
57 Third hydraulic cylinder
58 Front locking member (second retaining member)
81 Bottom-side support shaft (first support shaft)
82 Rod-side support shaft (second support shaft)
86 Lock spring (first biasing member, second biasing member)
87 Contact portion
77*a* Contact end (end of piston rod)
91 Back support shaft (third support shaft)
93 Front support shaft (fourth support shaft)
98 Second hydraulic cylinder support shaft (fifth support shaft)
99 Third hydraulic cylinder support shaft (sixth support shaft)

The invention claimed is:

1. A construction machine attachment mounting and demounting apparatus that mounts and demounts an attachment for work on and from an arm of a working device, the attachment mounting and demounting apparatus comprising:

a first member that includes a first hook and is coupled to the arm;

a second member that includes a second hook and is rotatably supported by the first member;

a first hydraulic cylinder that includes one end coupled to a first support shaft provided to the first member, and the other end coupled to a second support shaft provided to the second member, and rotates the second member relative to the first member;

a first retaining member that is rotatably supported by a third support shaft provided to the first member, the third support shaft being placed above the first hook, and is biased by a first biasing member in such a manner as to protrude from an opening portion of the first hook;

a second hydraulic cylinder that moves the first retaining member against the biasing force of the first biasing member in such a manner as to retract the first retaining member from the opening portion of the first hook in conjunction with the operation of the first hydraulic cylinder;

a second retaining member that is rotatably supported by a fourth support shaft provided to the second member, the fourth support shaft being placed above the second hook, and is biased by a second biasing member in such a manner as to protrude from an opening portion of the second hook; and a third hydraulic cylinder that moves the second retaining member against the second biasing member in such a manner as to retract the second retaining member from the opening portion of the second hook in conjunction with the operation of the first hydraulic cylinder.

2. The construction machine attachment mounting and demounting apparatus according to claim 1, wherein the second hydraulic cylinder is placed between the first support shaft and the third support shaft, and the third hydraulic cylinder is placed between the second support shaft and the fourth support shaft.

3. The construction machine attachment mounting and demounting apparatus according to claim 1, wherein a distance between shaft centers of the first support shaft and the second support shaft is less than a distance between shaft centers of the third support shaft and the fourth support shaft.

4. The construction machine attachment mounting and demounting apparatus according to claim 2, wherein a distance between shaft centers of a fifth support shaft that supports the second hydraulic cylinder and a sixth support shaft that supports the third hydraulic cylinder is less than a distance between shaft centers of the third support shaft and the fourth support shaft.

5. The construction machine attachment mounting and demounting apparatus according to claim 1, wherein upon a rod of the first hydraulic cylinder being maximally extended, a distal end of the second hook is forward of the fourth support shaft.

6. The construction machine attachment mounting and demounting apparatus according to claim 5, wherein the first hydraulic cylinder is a double-acting hydraulic cylinder, having a cylinder tube and a branch block, the second hydraulic cylinder and the third hydraulic cylinder are single-acting hydraulic cylinders, and the branch block is provided in the first member to cause pressure oil to branch into a path in which pressure oil for causing the rod of the first hydraulic cylinder to contract is supplied to one of two cylinder chambers of the cylinder tube and, simultaneously, pressure oil for causing rods of the second hydraulic cylinder and the third hydraulic cylinder to extend is supplied to the second hydraulic cylinder and the third hydraulic cylinder, and a path in which pressure oil for causing the rod of the first hydraulic cylinder to extend is supplied to the other cylinder chamber of the cylinder tube.

7. The construction machine attachment mounting and demounting apparatus according to claim 6, wherein the branch block is placed above the cylinder tube.

8. The construction machine attachment mounting and demounting apparatus according to claim 6, wherein an end of the rod of the second hydraulic cylinder and an end of the rod of the third hydraulic cylinder each has a hemispherical shape, and the end of the rod of the second hydraulic cylinder protrudes further than an end of a cylinder tube of the second hydraulic cylinder, and the end of the rod of the third hydraulic cylinder protrudes further than an end of a cylinder tube of the third hydraulic cylinder, during contraction of the second hydraulic cylinder and the third hydraulic cylinder.

9. A construction machine comprising:

the construction machine attachment mounting and demounting apparatus according to claim 1;

a travel device; and a front working device that is provided on a front side of the travel device and includes the arm that causes the attachment mounting and demounting apparatus to detachably support the attachment.

* * * * *